US009840100B2

(12) United States Patent
Tanjo

(10) Patent No.: US 9,840,100 B2
(45) Date of Patent: Dec. 12, 2017

(54) RECORDING APPARATUS

(71) Applicant: SEIKO EPSON CORPORATION, Tokyo (JP)

(72) Inventor: Toru Tanjo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/660,176

(22) Filed: Mar. 17, 2015

(65) Prior Publication Data

US 2015/0273892 A1 Oct. 1, 2015

(30) Foreign Application Priority Data

Mar. 27, 2014 (JP) ..... 2014-065646

(51) Int. Cl.
*B41J 3/60* (2006.01)
*B41J 29/02* (2006.01)
*B41J 29/13* (2006.01)

(52) U.S. Cl.
CPC ..... *B41J 29/023* (2013.01); *B41J 3/60* (2013.01); *B41J 29/02* (2013.01); *B41J 29/13* (2013.01)

(58) Field of Classification Search
USPC ..... 347/104; 400/642
See application file for complete search history.

(56) References Cited

U.S. PATENT DOCUMENTS 4,453,841 A * 6/1984 Bobick ..... B41J 3/60 271/186
4,849,788 A * 7/1989 Prebola ..... G03B 27/625 271/3.14
4,918,490 A * 4/1990 Stemmle ..... G03G 15/234 271/291
5,055,885 A * 10/1991 Yoshikado ..... G03G 15/234 271/186
5,448,348 A * 9/1995 Azeta ..... G03G 15/231 271/291
5,852,764 A * 12/1998 Kida ..... B65H 29/60 271/288
5,953,575 A * 9/1999 Park ..... G03G 15/232 271/186

(Continued)

FOREIGN PATENT DOCUMENTS

JP 2010-221644 10/2010
JP 2012-101927 5/2012

*Primary Examiner* — Matthew Luu
*Assistant Examiner* — Lily Kemathe
(74) *Attorney, Agent, or Firm* — Workman Nydegger

(57) ABSTRACT

A recording apparatus includes: a first transporting path which passes through a recording portion that performs recording on a medium fed from a medium accommodation cassette that accommodates the medium, in a straight line shape; a second transporting path which is connected to the first transporting path, and transports and switches back the medium in a reverse direction; a third transporting path which is connected to the second transporting path and allows the medium to bypass an upper side of the recording portion, to be reversed, and to be converged in the first transporting path; a fourth transporting path which is connected to a downstream of the first transporting path, reverses and discharges the medium, along an outer side of the second transporting path; and a medium receiving tray which receives the medium discharged from the fourth transporting path.

14 Claims, 22 Drawing Sheets

(56) References Cited

U.S. PATENT DOCUMENTS

| | | | | |
|---|---|---|---|---|
| 6,041,213 | A * | 3/2000 | Yanagi | G03G 15/231 271/301 |
| 6,601,949 | B1 * | 8/2003 | Kitahara | B41J 2/14233 347/70 |
| 6,909,872 | B2 * | 6/2005 | Eskey | B41J 3/60 399/364 |
| 7,079,805 | B2 * | 7/2006 | Suzuki | B41J 3/60 399/401 |
| 7,099,603 | B2 * | 8/2006 | Kimura | G03G 15/234 399/401 |
| 8,144,374 | B2 * | 3/2012 | Taniguchi | H04N 1/00551 358/474 |
| 8,195,083 | B2 * | 6/2012 | Bahrami | B41J 13/0045 399/401 |
| 8,579,286 | B2 * | 11/2013 | Hirai | B41J 3/60 271/186 |
| 8,909,123 | B2 * | 12/2014 | Moriyama | B41J 3/60 399/361 |
| 2004/0086310 | A1 * | 5/2004 | Eskey | B41J 3/60 399/401 |
| 2008/0012920 | A1 * | 1/2008 | Matsuda | B41J 11/20 347/104 |
| 2008/0240823 | A1 * | 10/2008 | Asada | B65H 3/0684 399/401 |
| 2012/0120464 | A1 * | 5/2012 | Hirai | B41J 3/60 358/498 |

* cited by examiner

RECORDING APPARATUS

BACKGROUND

1. Technical Field

The present invention relates to a recording apparatus which performs recording on a medium.

2. Related Art

In the recording apparatus which is represented by a facsimile or a printer, in particular, in the recording apparatus which can perform recording on both surfaces of the medium, a medium transporting path for reversing the medium is necessary. There are various aspects of the medium transporting path for reversing the medium, but, for example, there is a case where a reversing path which bends and reverses the medium and a path which switches back the medium are configured to be combined with each other. In JP-A-2010-221644, an example of such a recording apparatus is disclosed.

In the recording apparatus, there are a face-up discharge path which causes a surface on which final recording is performed to be an upper surface and discharges a paper sheet, and a face-down discharge path which causes the surface on which the final recording is performed to be a lower surface and discharges the paper sheet. In this face-down discharge path, in order to bend and reverse the paper sheet, a large space in a height direction of the apparatus is necessary.

Therefore, in a configuration in which the reversing path which bends and reverses the medium, a path which switches back the medium, and a face-down discharge path which causes the surface on which the final recording is performed to be the lower surface and discharges the medium are provided, a dimension increase in the height direction of the apparatus is inevitable and is an obstacle in reducing a size of the apparatus.

SUMMARY

An advantage of some aspects of the invention is to further reduce a size in a configuration in which a reversing path which reverses a medium, a path which switches back the medium, and a face-down discharge path which causes a surface on which final recording is performed to be a lower surface and discharges the medium are provided.

According to an aspect of the invention, there is provided a recording apparatus including: a medium accommodation cassette which accommodates a medium; a first transporting path which transports the medium which is fed from the medium accommodation cassette to the above and reverses the medium, and passes through a recording portion that performs recording on the medium in a straight line shape; a second transporting path which is connected to a downstream of the first transporting path, and transports and switches back the medium in a reverse direction after transporting the medium which passes through the recording medium and reversing the medium; a third transporting path which is connected to the second transporting path and allows the medium transported in the reverse direction to bypass an upper side of the recording portion, to be reversed, and to be converged at a position on an upstream side of the recording portion in the first transporting path; a fourth transporting path which is connected to the downstream of the first transporting path, reverses the medium which passes through the recording portion and discharges the medium to be along an outer side of the second transporting path; and a medium receiving tray which receives the medium discharged from the fourth transporting path. Above the medium accommodation cassette, the first transporting path, the recording portion, the third transporting path, and the medium receiving tray are disposed to be overlapped with each other.

In this case, after sending the medium which passes through the recording portion, the second transporting path which switches back and transports the medium in the direction reverse to a sending direction is formed along the fourth transporting path which bends, reverses, and discharges the medium which passes through the recording portion. For this reason, the second transporting path and the fourth transporting path do not occupy a region individually and independently in the recording apparatus, and it is possible to further reduce a size of the apparatus. Furthermore, hereinafter, for convenience, there is a case where the second transporting path is called or additionally described as a "switching-back path", there is a case where the third transporting path is called or additionally described as a "reversing path", and there is a case where the fourth transporting path is called or additionally described as a "face-down discharge path".

In addition, since the second transporting path (switching-back path) and the fourth transporting path (face-down discharge path) are placed on the side of the third transporting path (reversing path) with respect to the first transporting path, the second transporting path (switching-back path), the third transporting path (reversing path), and the fourth transporting path (face-down discharge path) use at least a part of the same region in the apparatus height direction, and it is possible to more effectively increase a dimension in the height direction of the apparatus.

In addition, since the second transporting path (switching-back path) and the third transporting path (reversing path) are in a region occupied by the fourth transporting path (face-down discharge path) in the height direction, the second transporting path (switching-back path) and the third transporting path (reversing path) do not occupy the region independently in the height direction, and it is possible to further reduce the size of the apparatus.

Furthermore, since the second transporting path (switching-back path) is disposed on an inner side of the fourth transporting path (face-down discharge path), a path which faces the third transporting path (reversing path) from the second transporting path (switching-back path) does not intersect a path which faces the fourth transporting path (face-down discharge path) from the first transporting path, and it is possible to improve a degree of freedom of control when recording, and further, to improve throughput.

In addition, when the recording portion performs recording by ejecting liquid onto the medium, the medium onto which the liquid is ejected tends to consider a surface (recording surface) onto which the liquid is ejected as an outer side and bends the medium (curl tendency). When the medium is reversed in this manner and sent to the recording portion again, the medium considers the surface which faces the recording head as the inner side and bends the medium. For this reason, a tip end or a rear end of the medium is in contact with the recording head, and a so-called head scratch is likely to be generated.

However, in this case, since the second transporting path (switching-back path) considers a first surface (a surface on which recording is already performed) which faces the recording head that constitutes the recording portion in the medium which passes through the first transporting path as an inner side, and bends the medium, that is, bends the medium in a direction which corrects the curl tendency, it is possible to prevent or suppress the above-described head scratch.

According to the aspect, the medium receiving tray may obtain an upwardly inclined posture which is an upward posture toward a side far from an outlet of the fourth transporting path. The third transporting path may be reversed after being inclined upwardly along the upwardly inclined posture of the medium receiving tray and converge with the first transporting path.

In this case, since the third transporting path (reversing path) is reversed after being inclined upwardly along the upwardly inclined posture of the medium receiving tray and converges with the first transporting path, it is possible to reduce a curvature of a reversed part in the third transporting path (reversing path), and to smoothly reverse the medium without applying a force.

According to the aspect, in the third transporting path, a roller pair for removing a skew may be disposed in the middle of a reversing path.

In this case, since skew-removing is performed even when a skew is generated in the medium in the middle of the reversing path, recording is performed on a rear surface which does not have a shift.

According to the aspect, the recording apparatus may further include a manual tray. At a converging portion between the third transporting path and the first transporting path, a feeding path of the manual tray may be converged.

In this case, it is possible to reduce the size of the apparatus, and to perform both recording on one surface and recording on both surfaces of the medium fed by the manual tray.

According to the aspect, the recording apparatus may further include: a first flap which switches a downstream of the first transporting path and an upstream of the second transporting path to be in a connected state and a disconnected state; and a second flap which connects the second transporting path and the third transporting path to each other when the connected state is switched to the disconnected state by the first flap.

In this case, it is possible to dispose the second transporting path which is the switching-back path to be along the fourth transporting path which is the discharge path, and to reduce the size of the apparatus.

According to the aspect, after a first medium is fed to the first transporting path and recording is performed in the recording portion, the first transporting path and the second transporting path may be connected to each other by the first flap, and the first medium may be transported to the second transporting path. After this, when the following second medium is fed to the first transporting path, the second transporting path and the third transporting path are connected to each other by the second flap, and the first medium is transported to the third transporting path, the second medium may be transported to the recording portion, and recording may be performed.

In this case, even when the following second medium is transported, it is possible to transport the second medium without interfering the transporting of the first medium, and to improve throughput of recording on both surfaces while reducing the size of the apparatus.

According to the aspect, after the first medium is transported to the third transporting path, the first transporting path and the second transporting path may be connected to each other by the first flap, and the second medium may be transported to the second transporting path. After this, the first medium which is reversed in the third transporting path may be transported to the recording portion and recording may be performed, the first flap may be in the disconnected state, and the first transporting path and the fourth transporting path may be connected to each other.

In this case, even when the following second medium is transported, it is possible to transport the second medium without interfering the transporting of the first medium, and to improve throughput of recording on both surfaces while reducing the size of the apparatus.

According to the aspect, the first medium may be transported to the fourth transporting path. When the second transporting path and the third transporting path are connected to each other by the second flap, and the second medium is transported to the third transporting path, the following third medium may be fed to the first transporting path and may be transported to the recording portion, and recording may be performed.

In this case, furthermore, even when the following third medium is transported, it is possible to transport the third medium without interfering the transporting of the first medium and the second medium, and to improve throughput of recording on both surfaces while reducing the size of the apparatus.

According to the aspect, the second transporting path and the third transporting path may be respectively provided with a plurality of spurs on a side which faces a recording surface of the medium on which recording is performed in the recording portion.

In this case, while reducing the size of the apparatus, when reversing the medium for recording on the rear surface, it is possible to suppress contact with the recording surface on which recording is performed on one side, and to suppress deterioration of recording quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
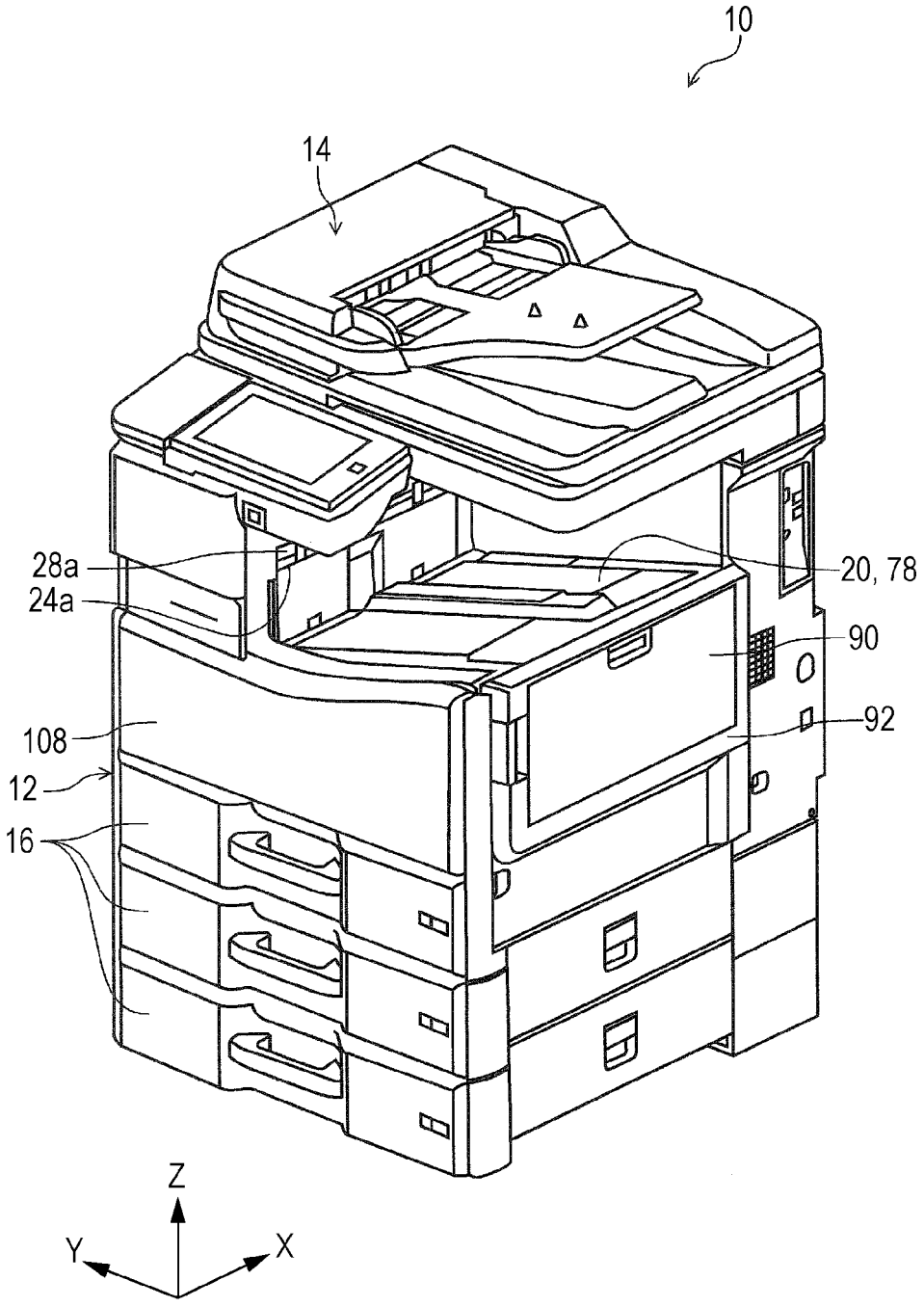
FIG. 1 is an external appearance perspective view of a printer according to the invention.

Hereinafter, an embodiment of the invention will be described based on the drawings. Furthermore, the same configurations in each embodiment will be given the same reference numerals, and will be described only in a first embodiment. The description of the same configuration will be omitted in the following embodiments.

Figure 2:
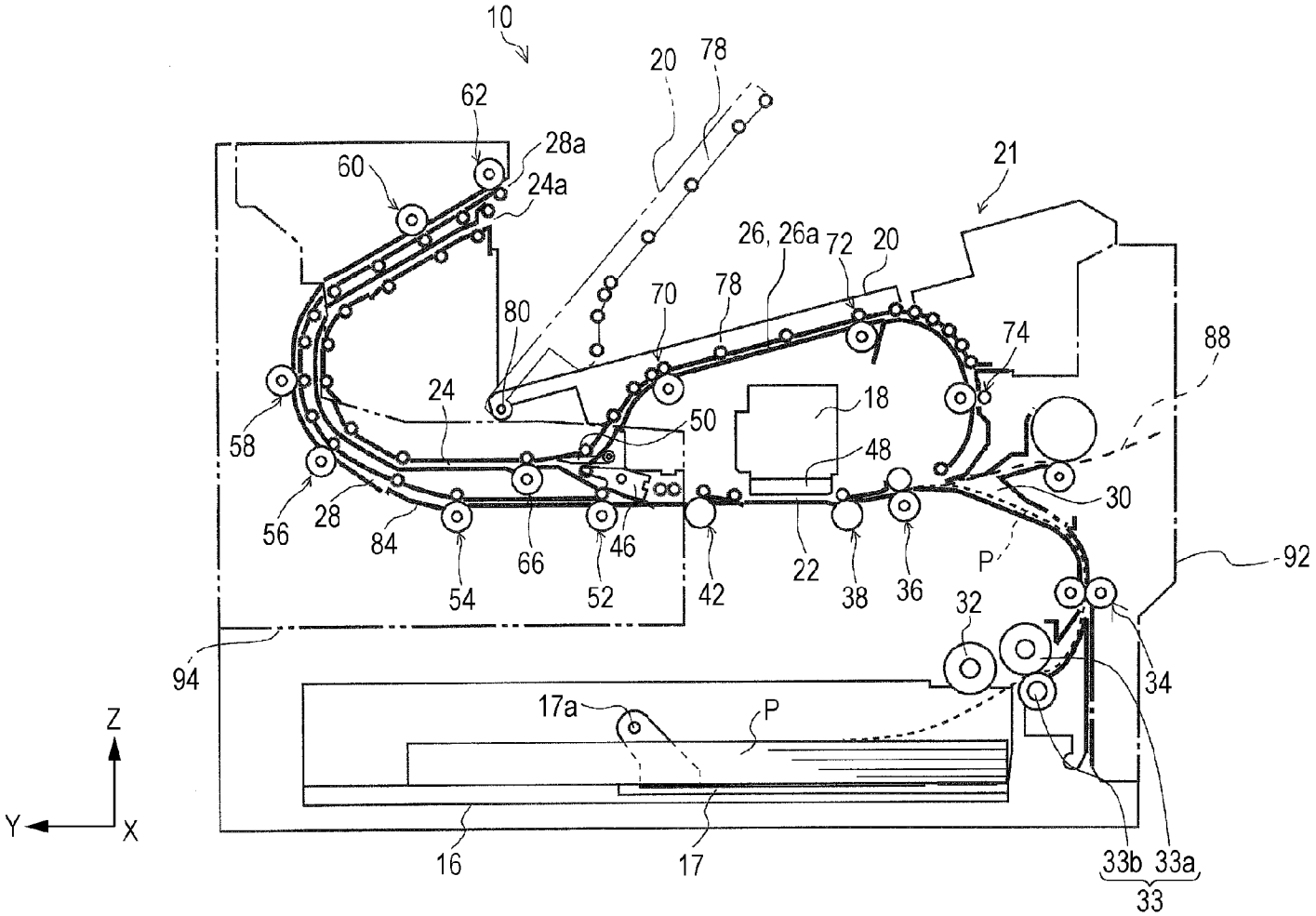
FIG. 2 is a view illustrating a medium transporting path in the printer according to the invention.
Figure 3:
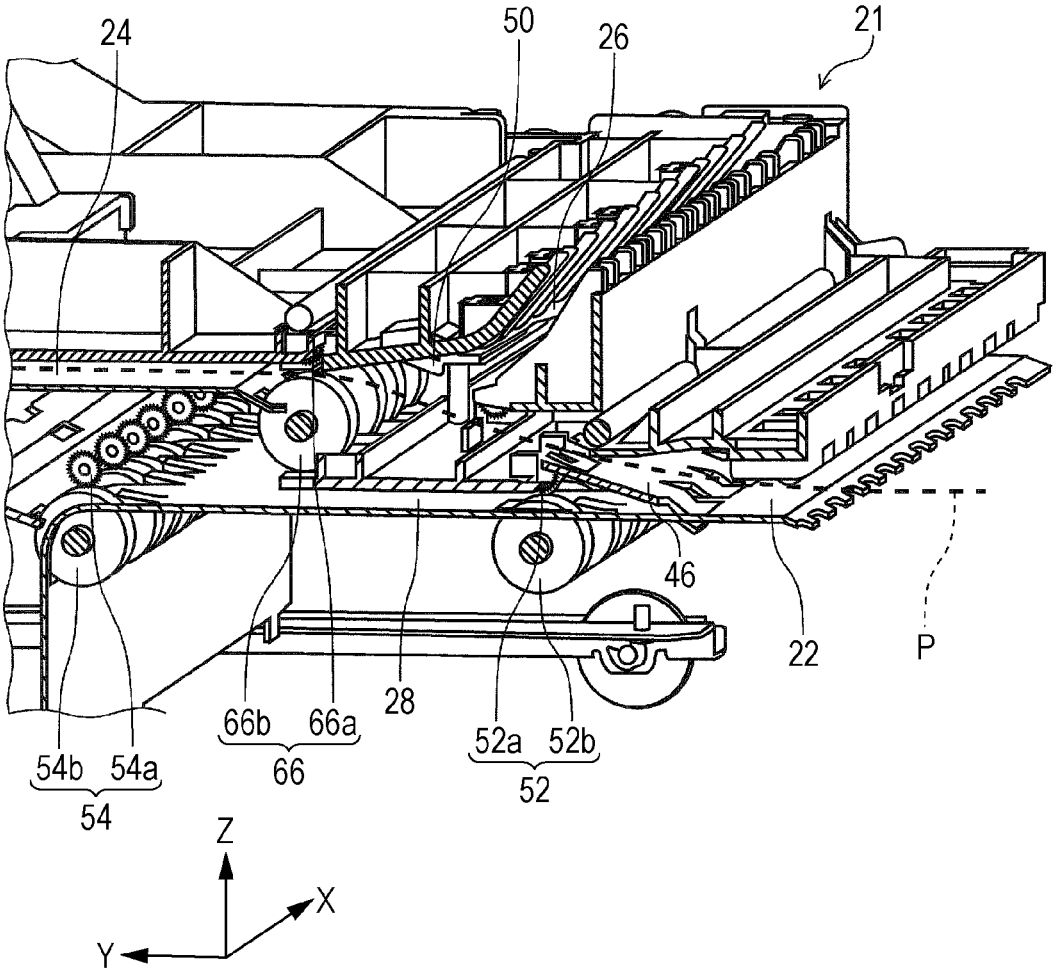
FIG. 3 is a perspective view illustrating a state of a flap which connects a first transporting path and a second transporting path to each other when transporting a medium from the first transporting path to the second transporting path.
Figure 4:
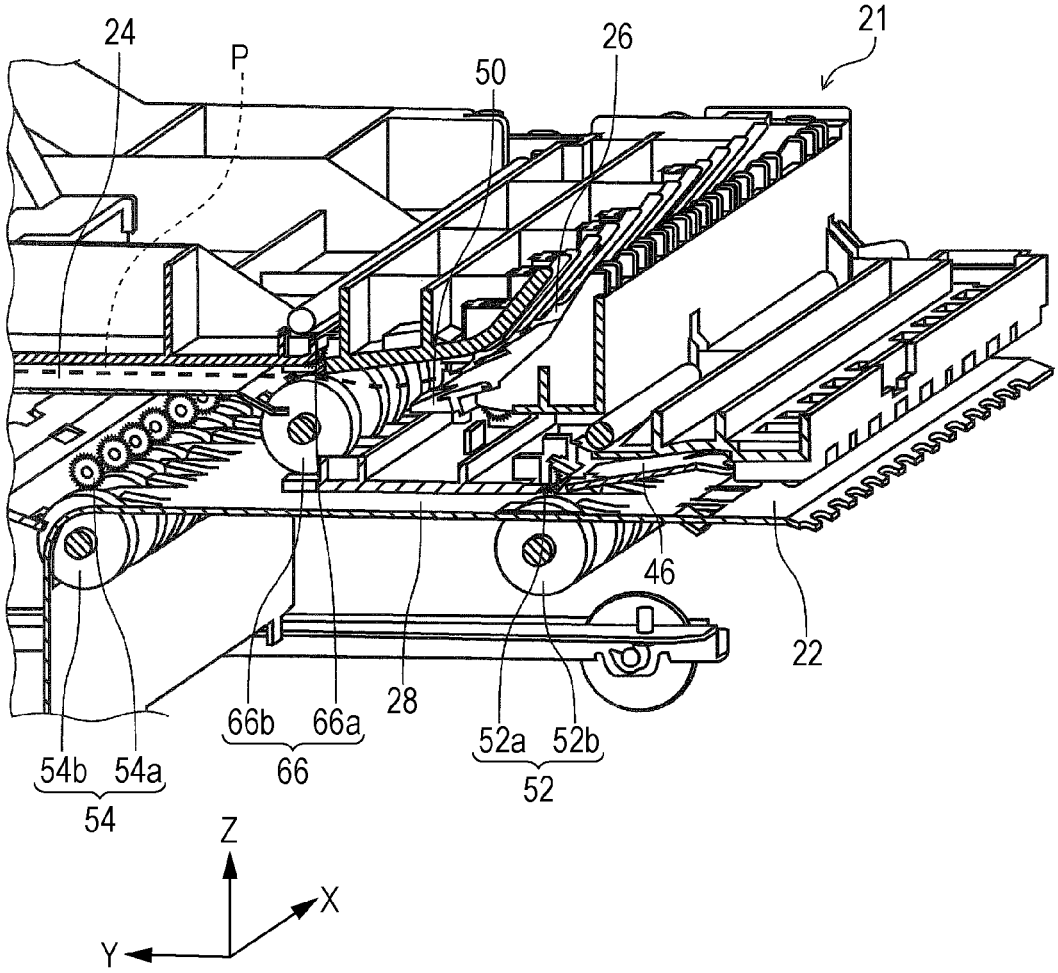
FIG. 4 is a perspective view illustrating a state of a flap which connects the second transporting path and a third transporting path to each other when transporting a medium from the second transporting path to the third transporting path.
Figure 5:
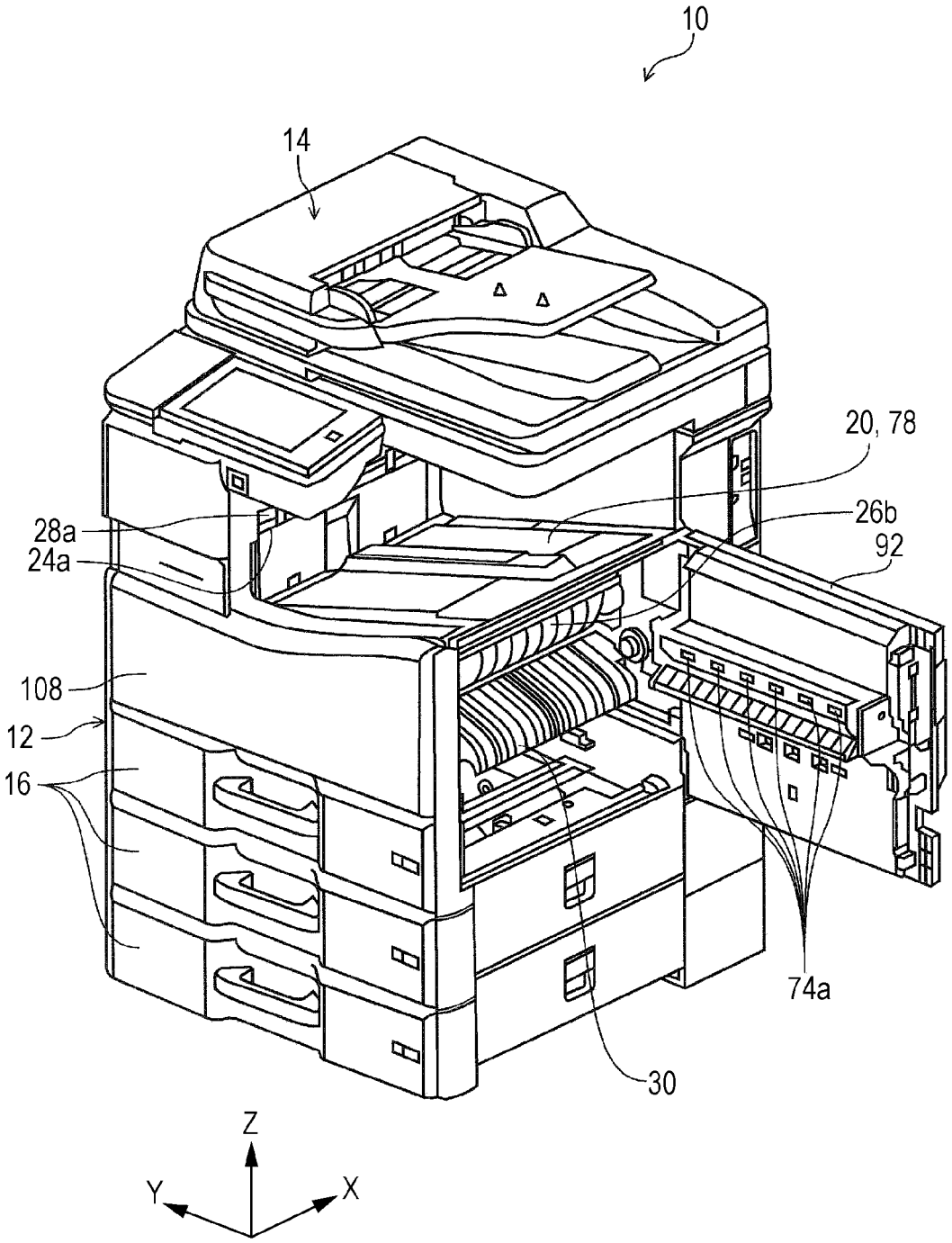
FIG. 5 is a perspective view in a state where an opening/closing body which constitutes a part of a transporting path is opened with respect to an apparatus main body in the printer according to the invention.

FIG. 1 is an external appearance perspective view of a printer according to the invention. FIG. 2 is a view illustrating a medium transporting path in the printer according to the invention. FIG. 3 is a perspective view illustrating a state of a flap which connects a first transporting path and a second transporting path to each other when transporting a medium from the first transporting path to the second transporting path. FIG. 4 is a perspective view illustrating a state of the flap which connects the second transporting path and a third transporting path to each other when transporting a medium from the second transporting path to the third transporting path. FIG. 5 is a perspective view in a state where an opening/closing body which constitutes a part of a transporting path is opened with respect to an apparatus main body in the printer according to the invention.

Figure 6:
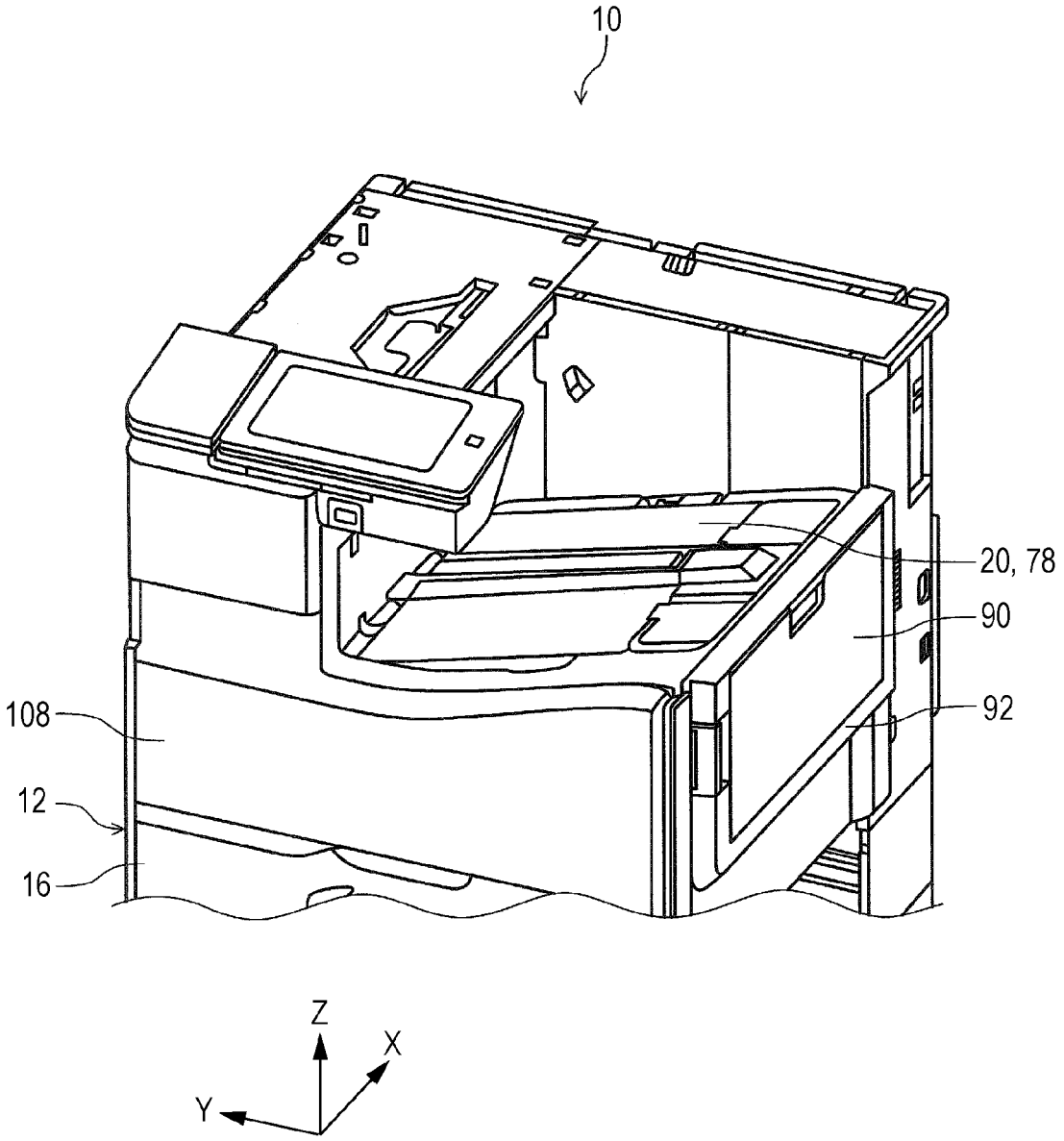
FIG. 6 is a perspective view illustrating a medium receiving tray in the printer according to the invention.
Figure 7:
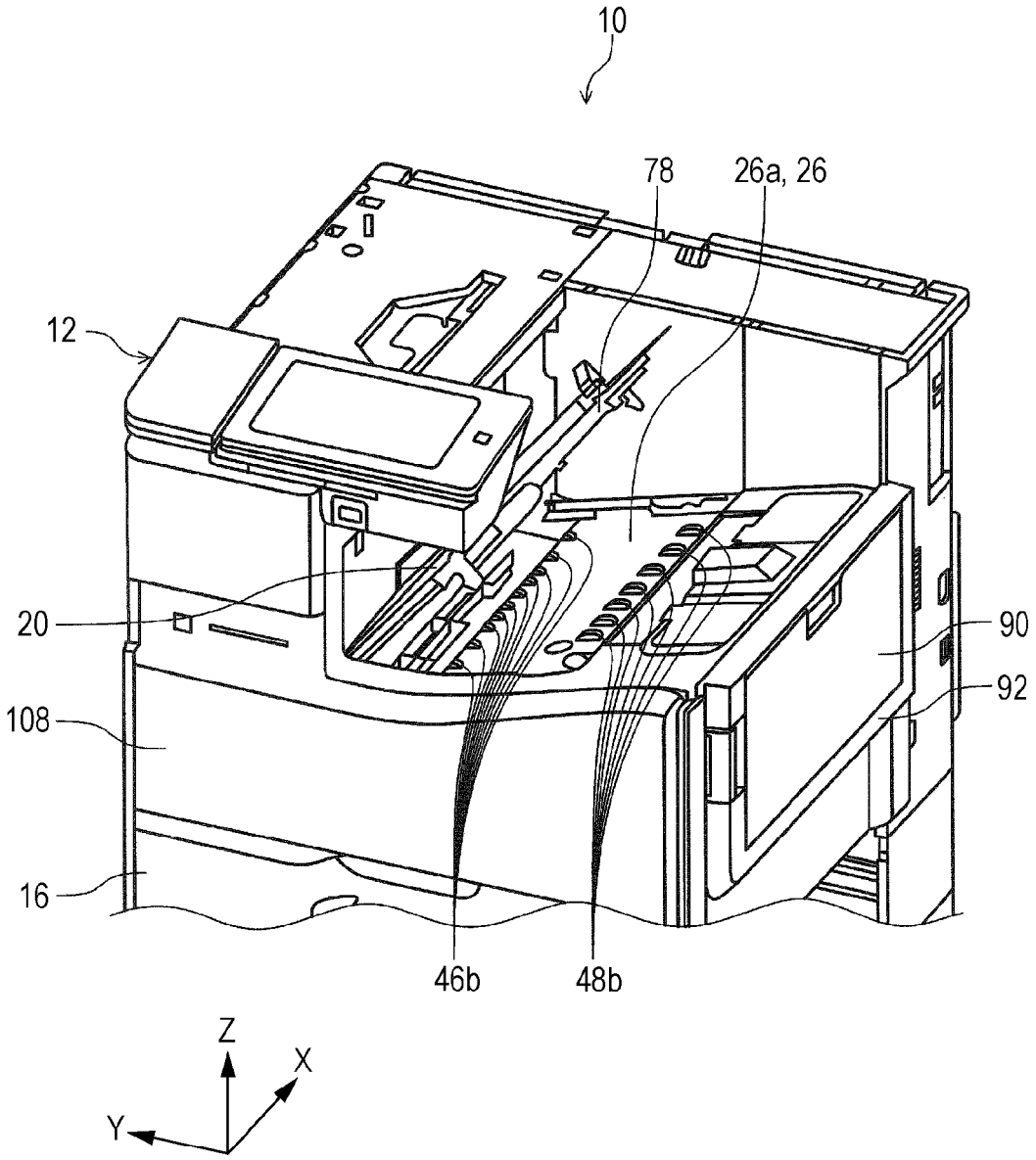
FIG. 7 is a perspective view in a state where the medium receiving tray is opened with respect to the apparatus main body.
Figure 8:
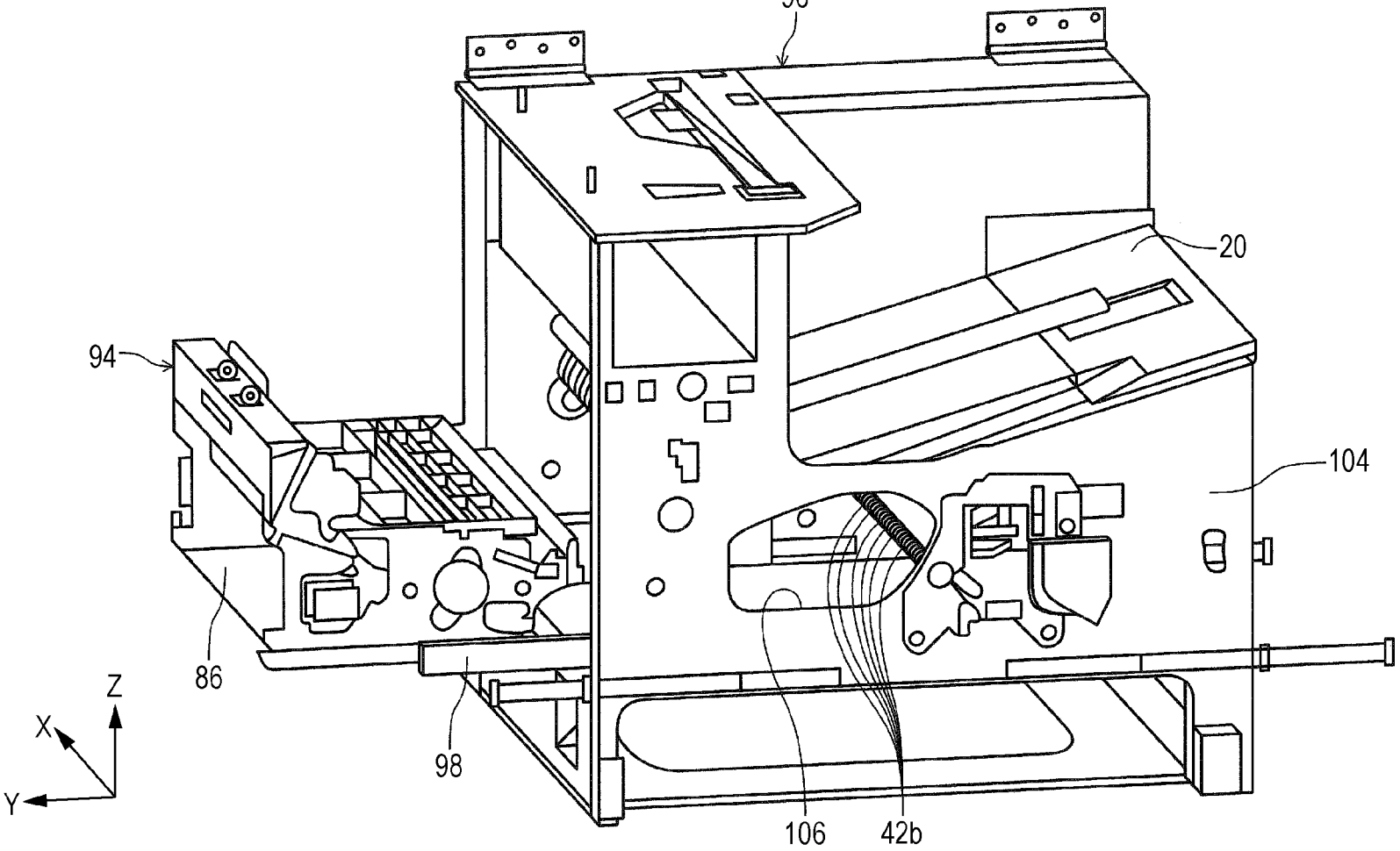
FIG. 8 is a perspective view illustrating a state where a unit body is drawn out in the apparatus main body.
Figure 9:
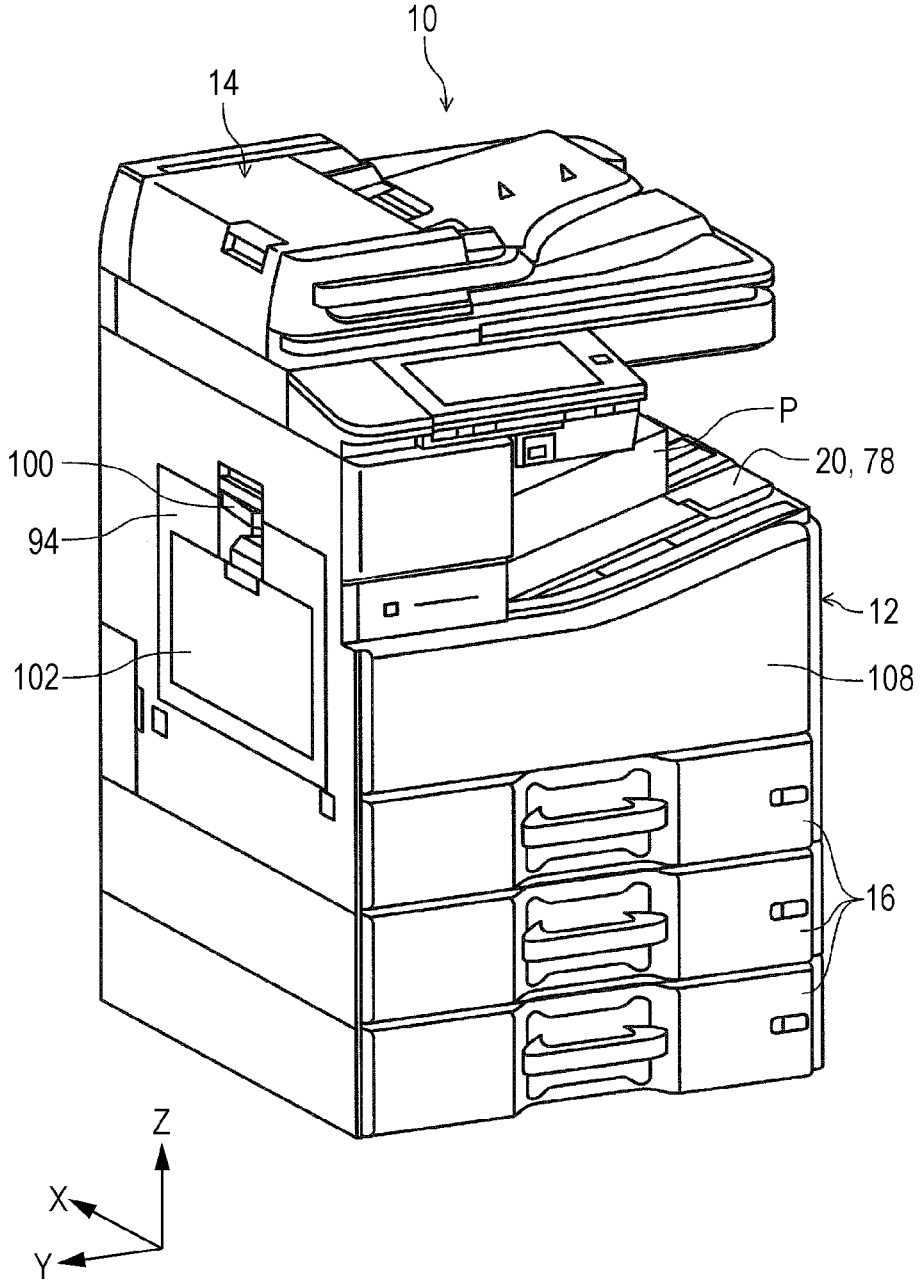
FIG. 9 is a perspective view of the printer according to the invention.
Figure 10:
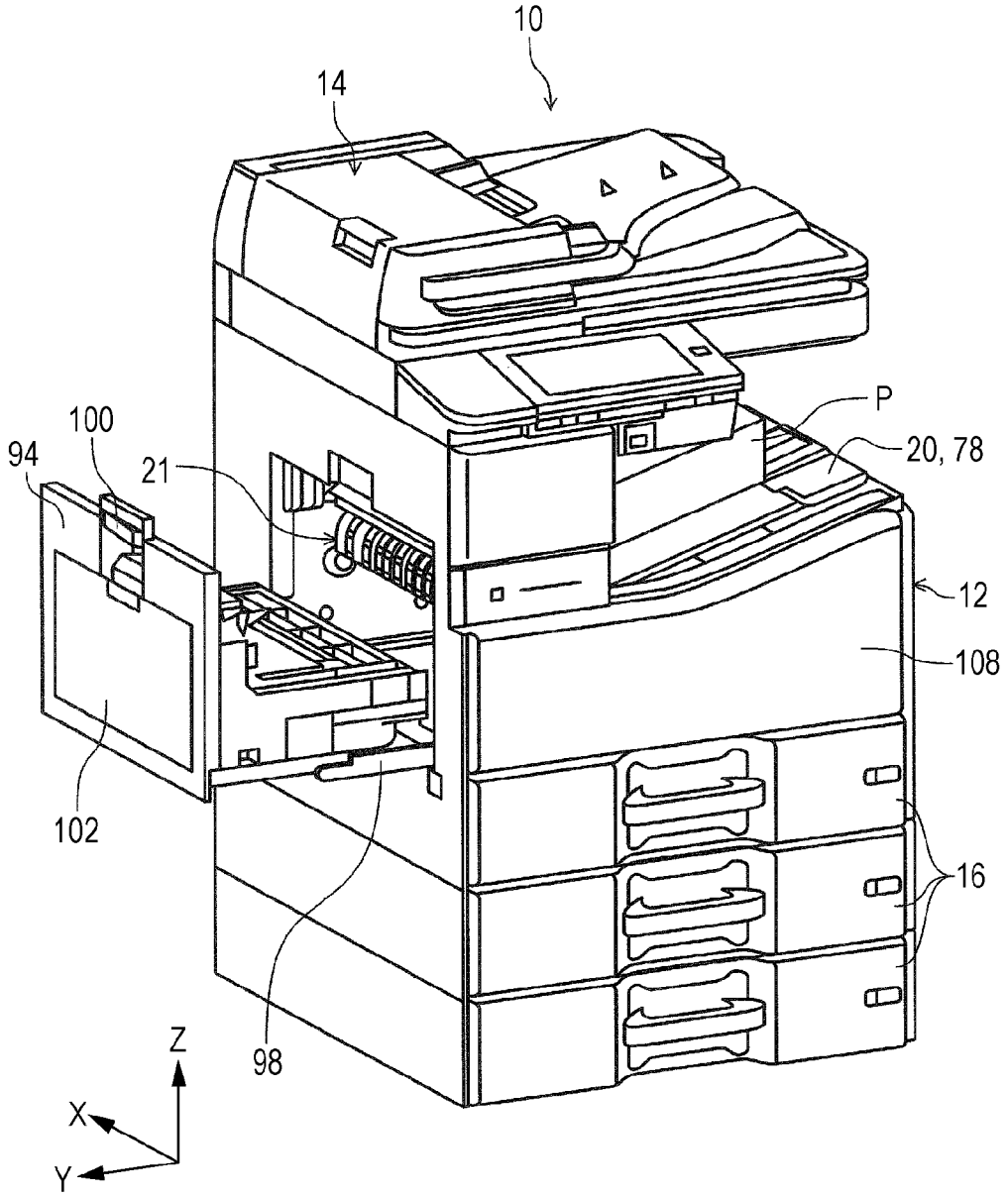
FIG. 10 is a perspective view illustrating a state where a unit which constitutes a part of the medium transporting path is drawn out from the apparatus main body.

FIG. 6 is a perspective view illustrating a medium receiving tray in the printer according to the invention. FIG. 7 is a perspective view in a state where the medium receiving tray is opened with respect to the apparatus main body. FIG. 8 is a perspective view illustrating a state where a unit body is drawn out in the apparatus main body. FIG. 9 is a perspective view of the printer according to the invention. FIG. 10 is a perspective view illustrating a state where a unit which constitutes a part of the medium transporting path is drawn out from the apparatus main body.

Figure 11:
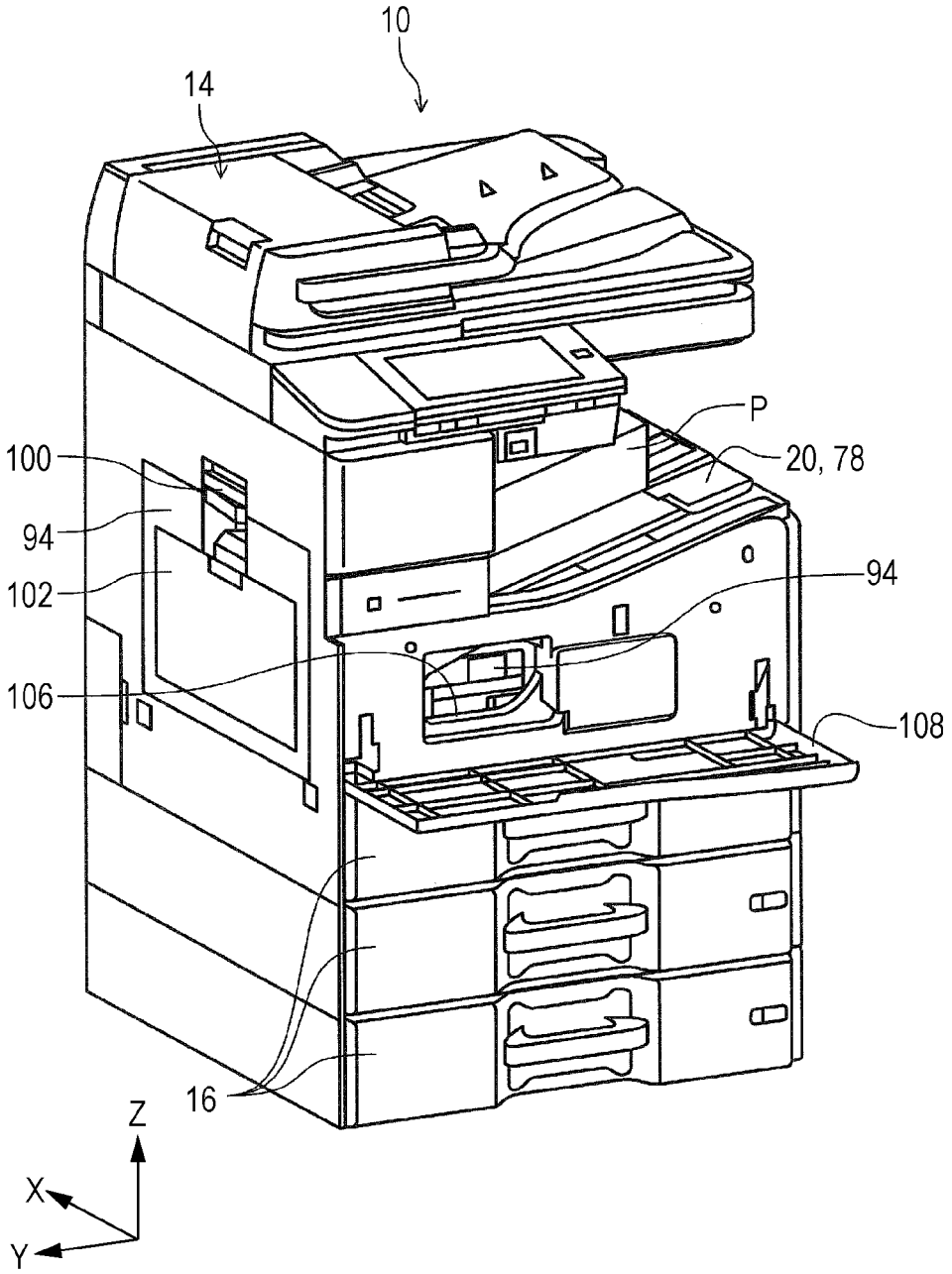
FIG. 11 is a perspective view illustrating a state where a cover on a front surface side of the printer is opened.
Figure 12:
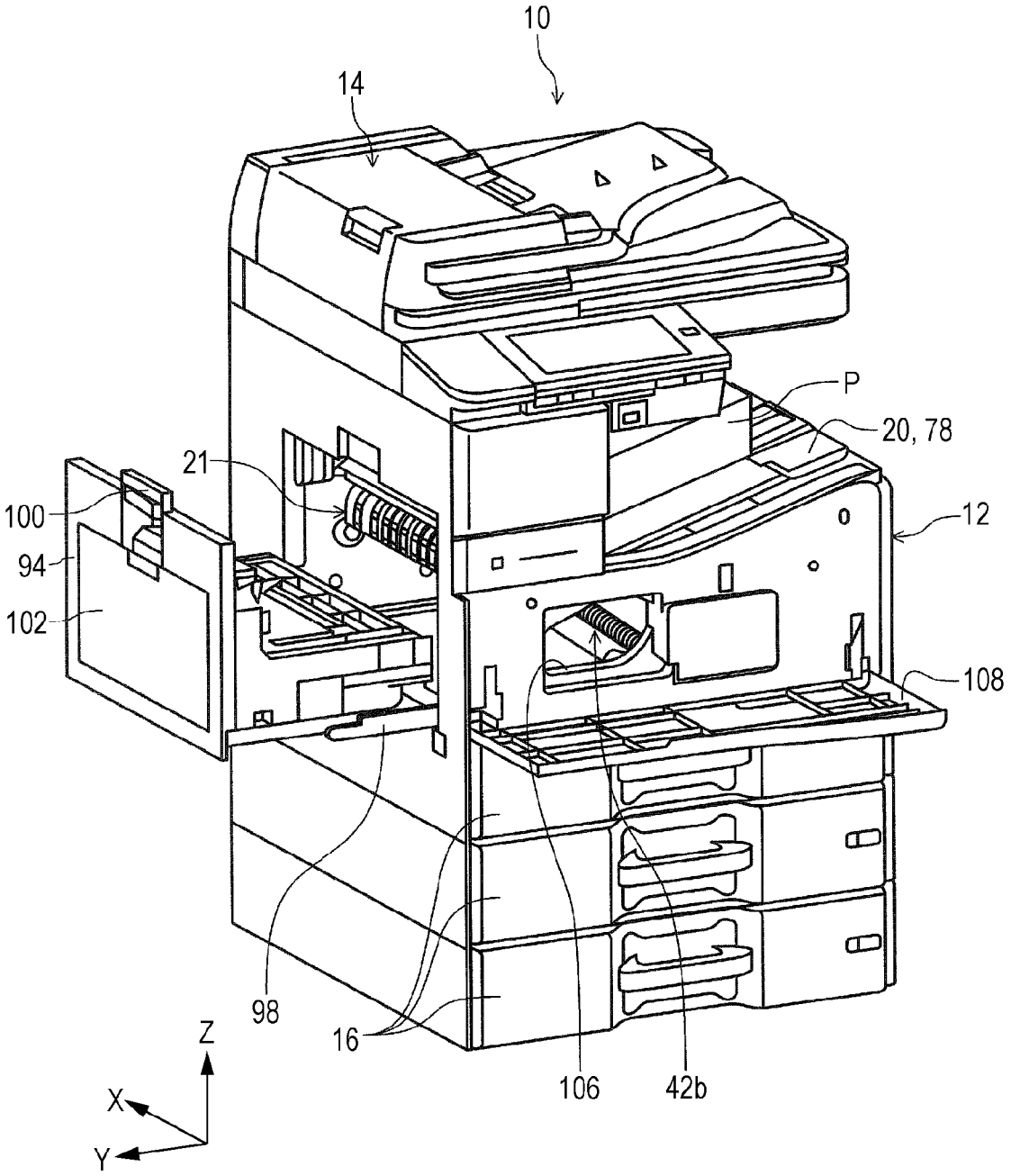
FIG. 12 is a perspective view illustrating a state where the cover on the front surface side of the printer is opened, the unit is drawn out from the apparatus main body, and it is possible to access a transporting roller pair from an opening.
Figure 13:
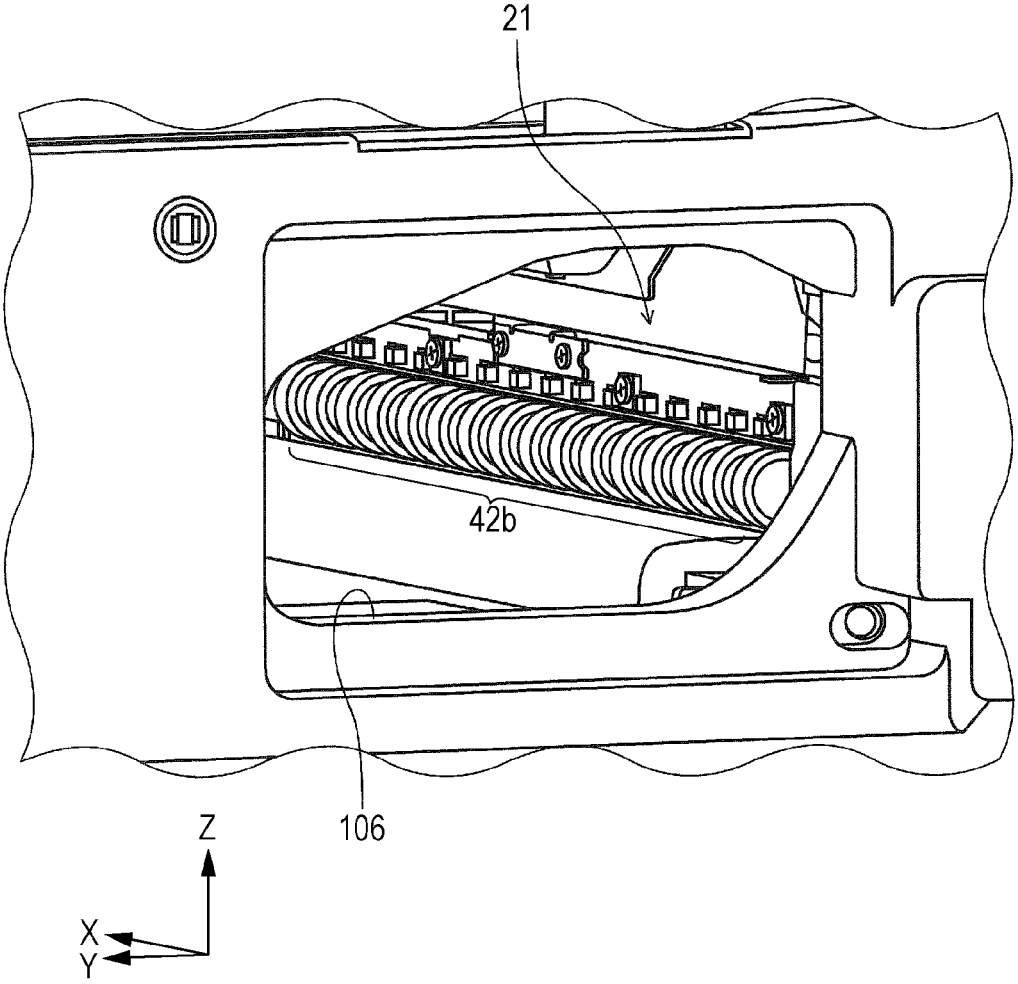
FIG. 13 is a perspective view of the transporting roller pair which can be accessed from an opening portion.
Figure 14:
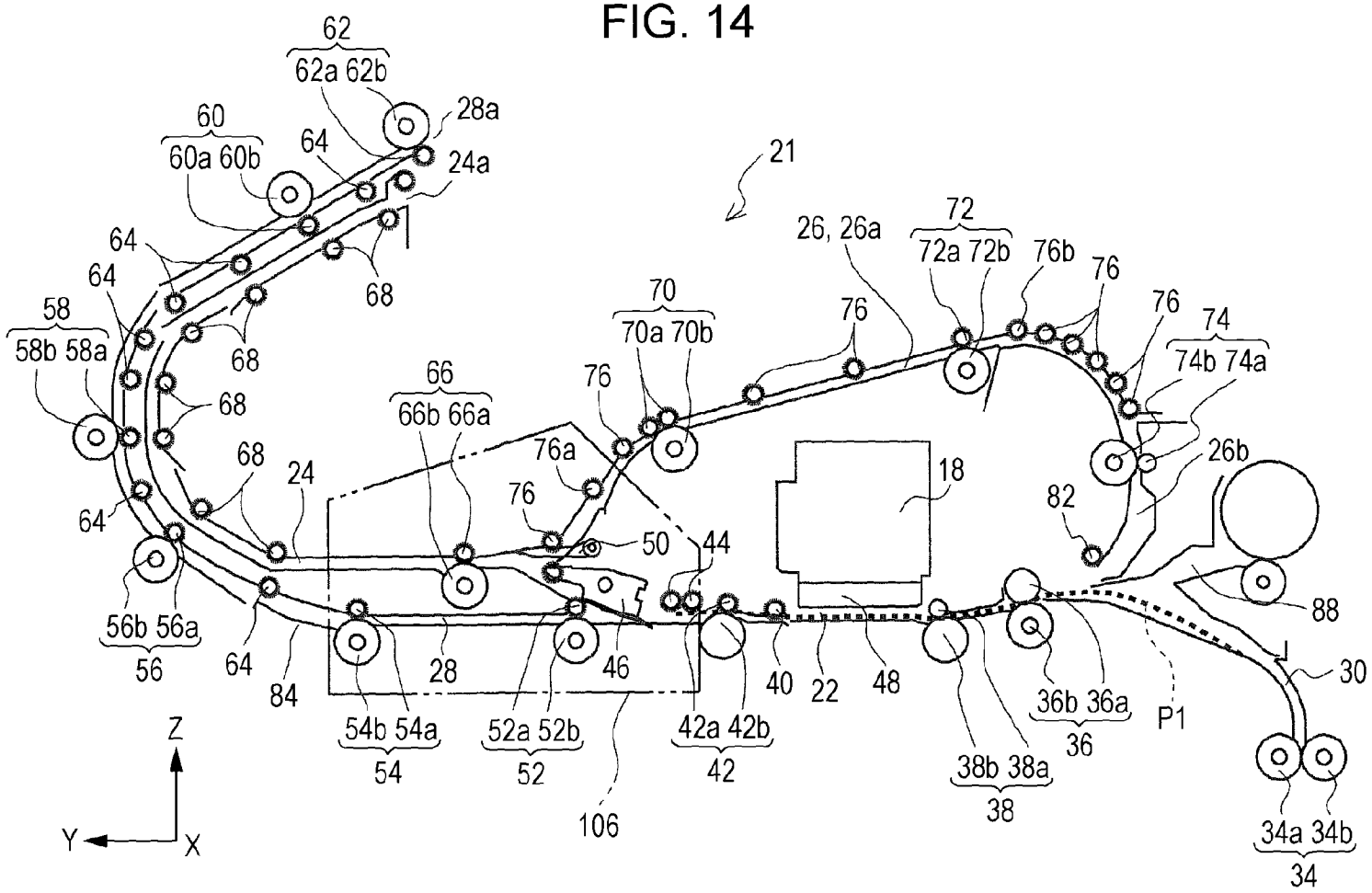
FIG. 14 is a view illustrating a first state of a transported medium in the medium transporting path.
Figure 15:
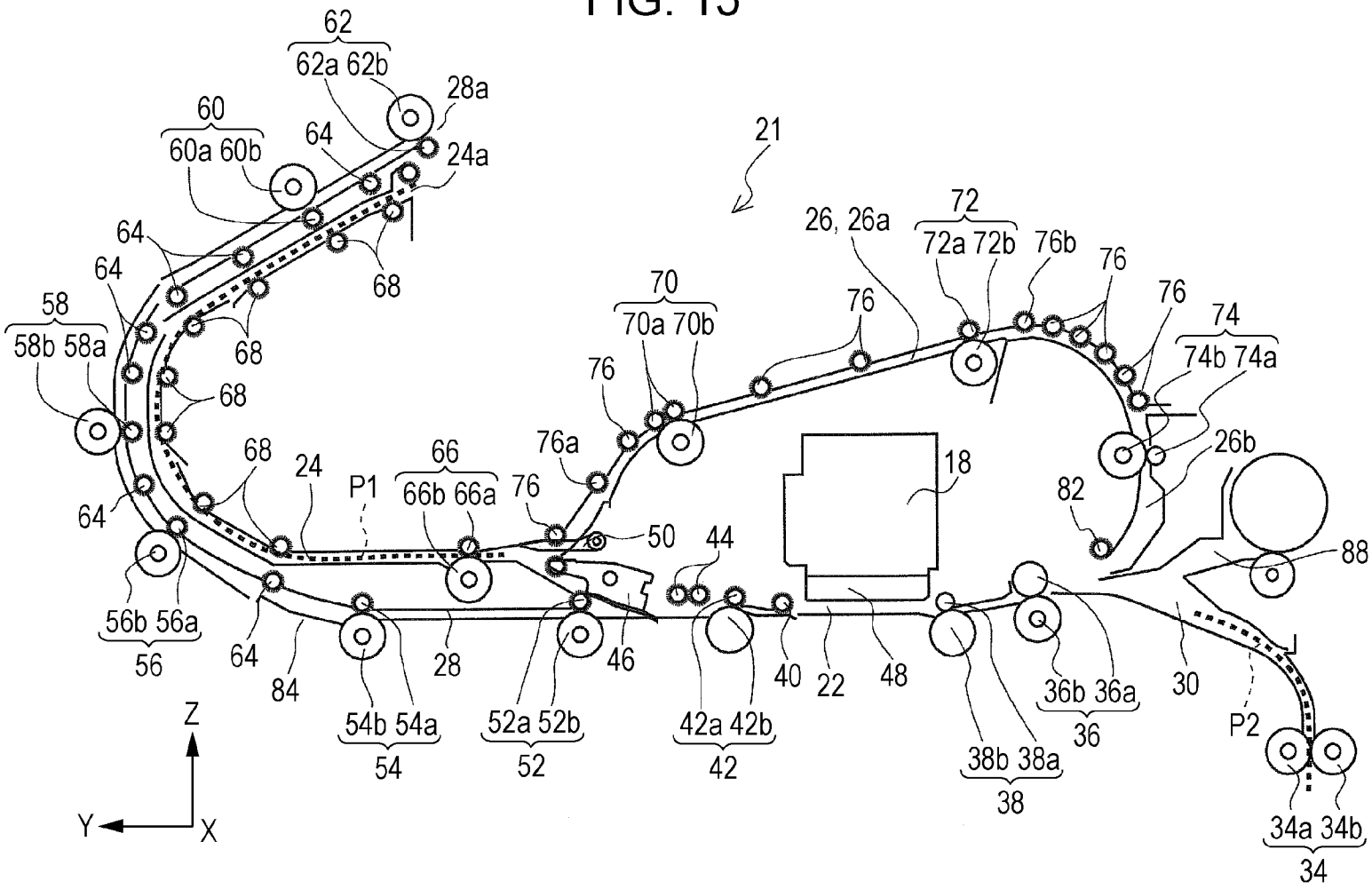
FIG. 15 is a view illustrating a second state of the transported medium in the medium transporting path.

FIG. 11 is a perspective view illustrating a state where a cover on a front surface side of the printer is opened. FIG. 12 is a perspective view illustrating a state where the cover on the front surface side of the printer is opened, the unit is drawn out from the apparatus main body, and it is possible to access a transporting roller pair from an opening. FIG. 13 is a perspective view of the transporting roller pair which can be accessed from an opening portion. FIG. 14 is a view illustrating a first state of a transported medium in the medium transporting path. FIG. 15 is a view illustrating a second state of the transported medium in the medium transporting path.

Figure 16:
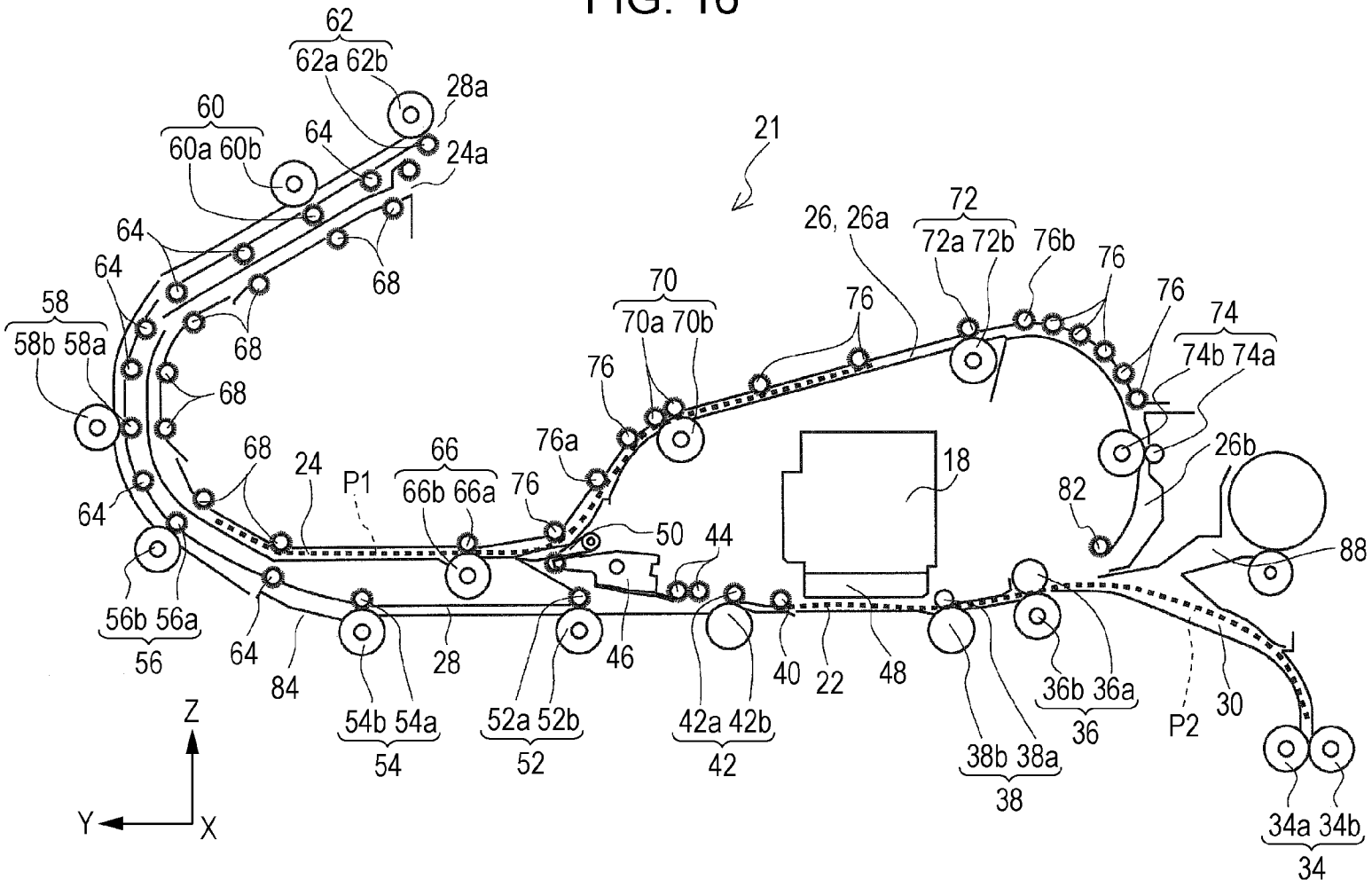
FIG. 16 is a view illustrating a third state of the transported medium in the medium transporting path.
Figure 17:
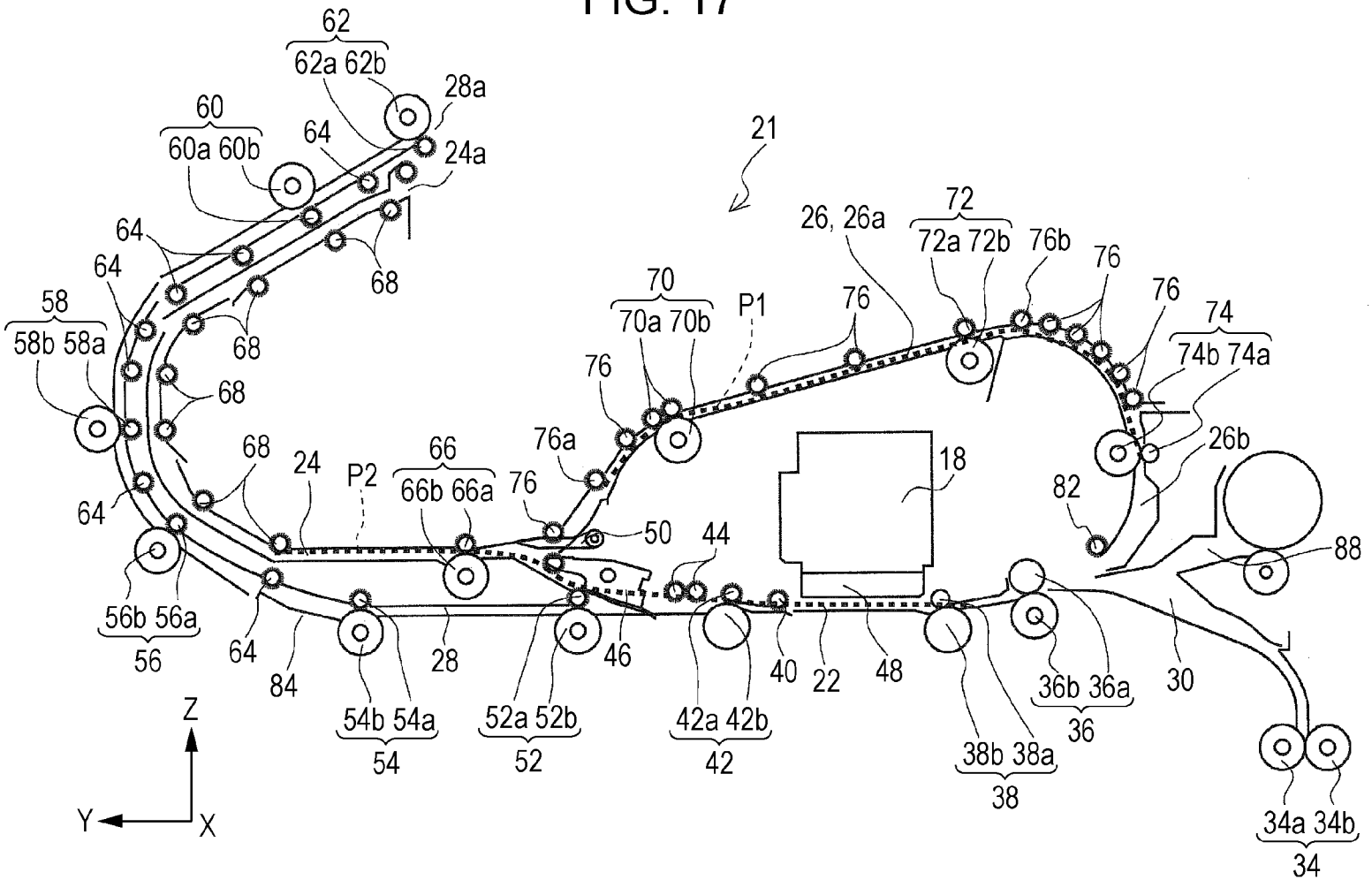
FIG. 17 is a view illustrating a fourth state of the transported medium in the medium transporting path.
Figure 18:
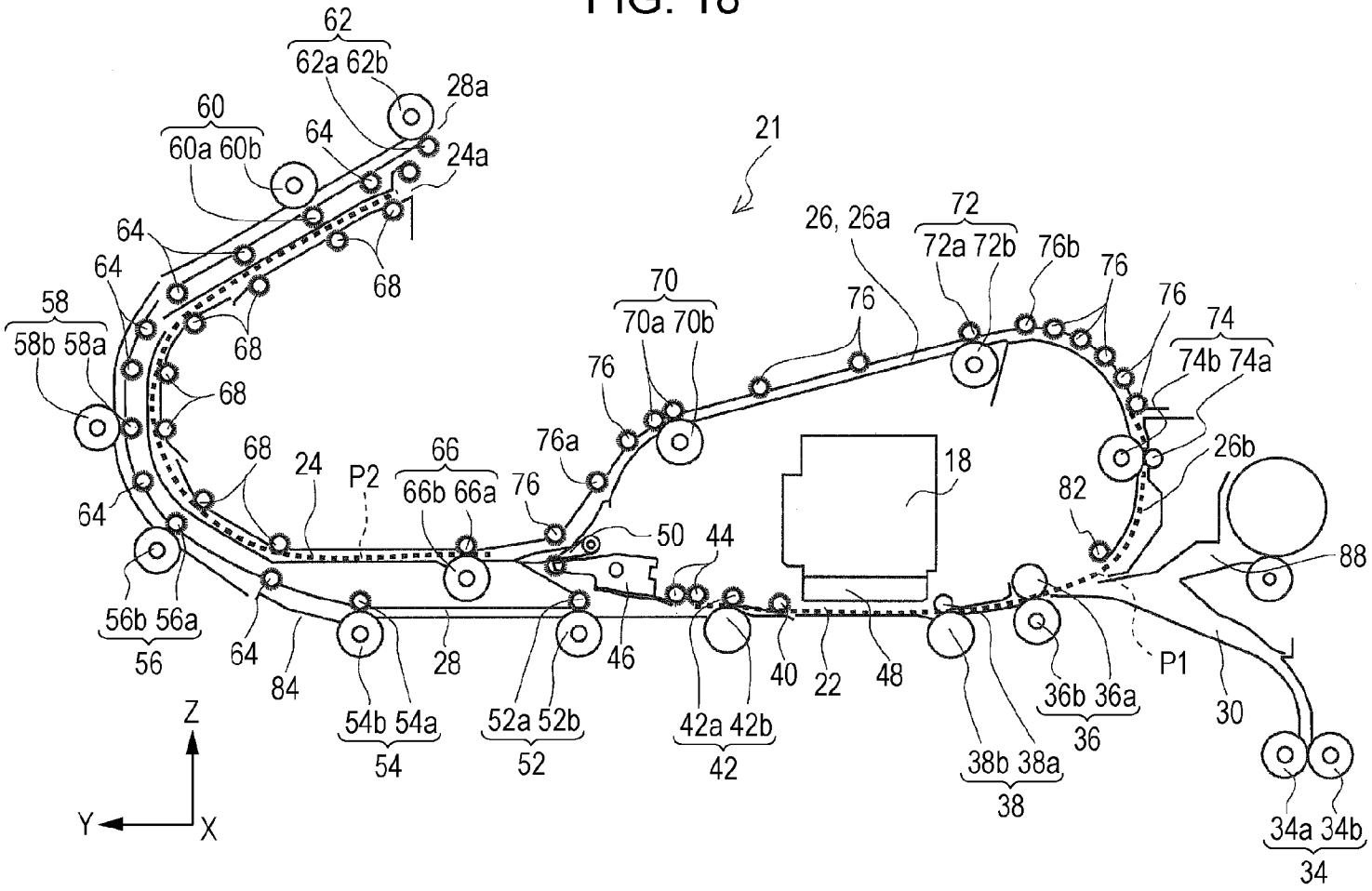
FIG. 18 is a view illustrating a fifth state of the transported medium in the medium transporting path.
Figure 19:
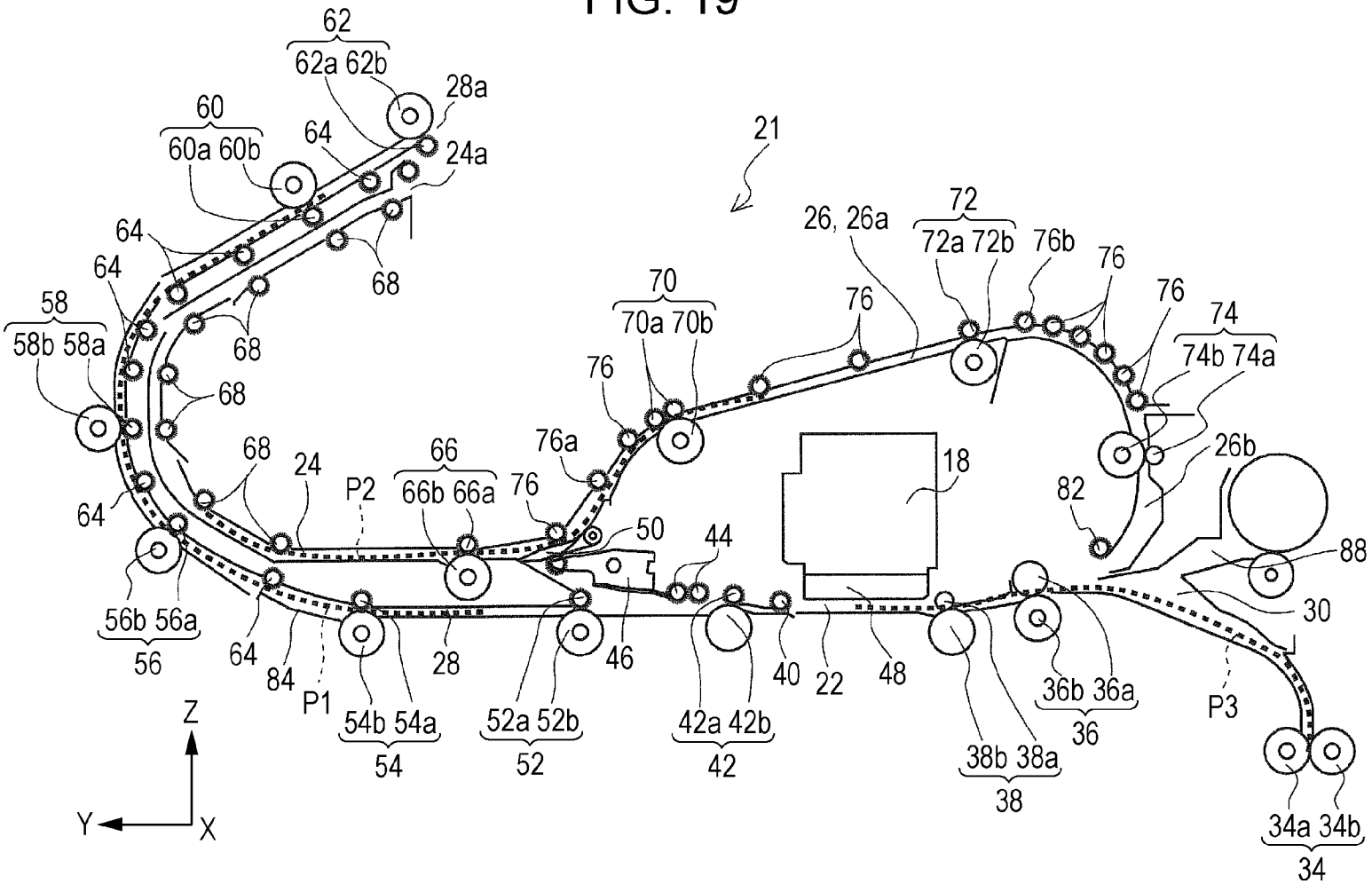
FIG. 19 is a view illustrating a sixth state of the transported medium in the medium transporting path.
Figure 20:
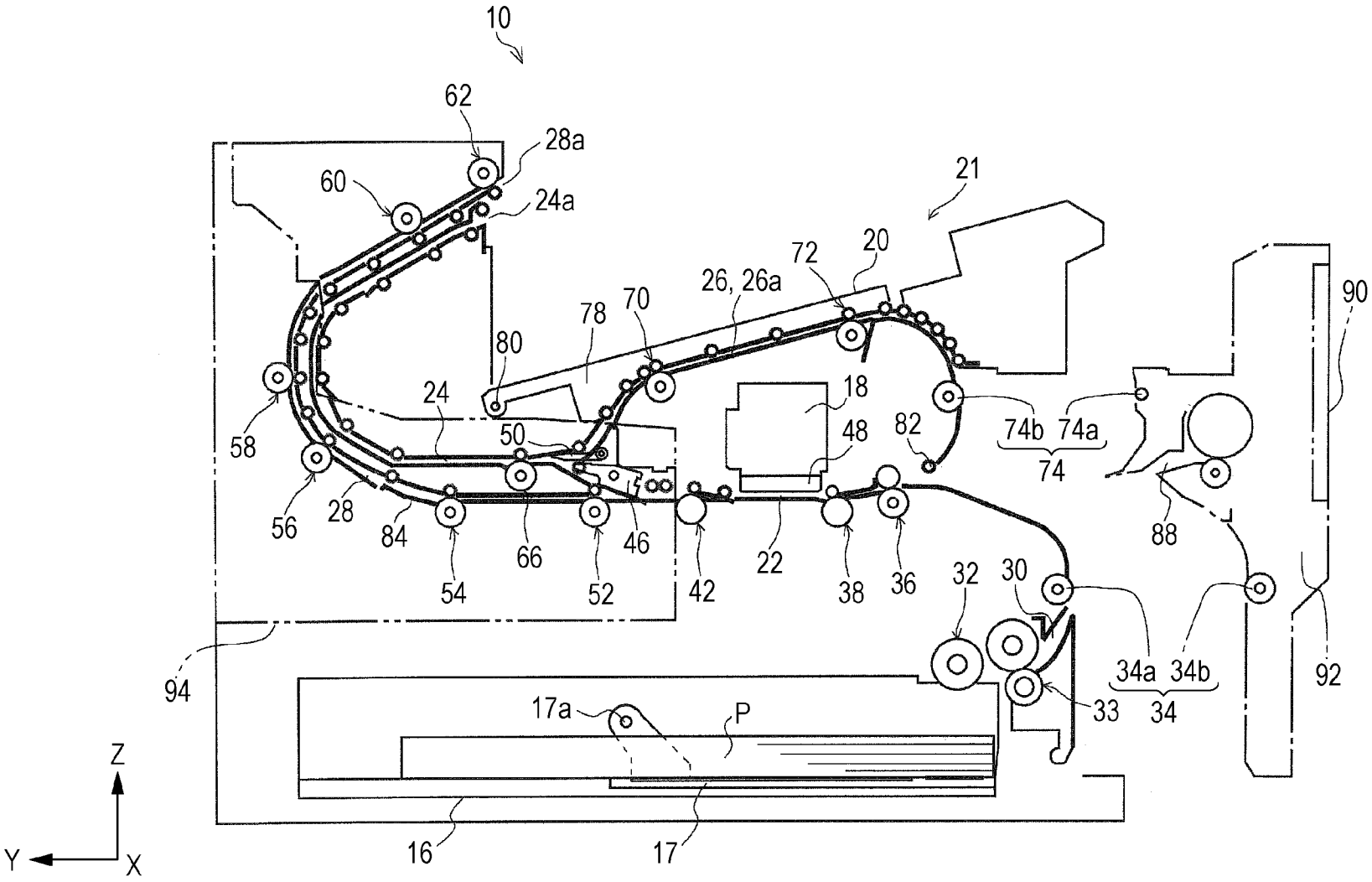
FIG. 20 is a view illustrating a state where an opening/closing unit is detached from the medium transporting path.
Figure 21:
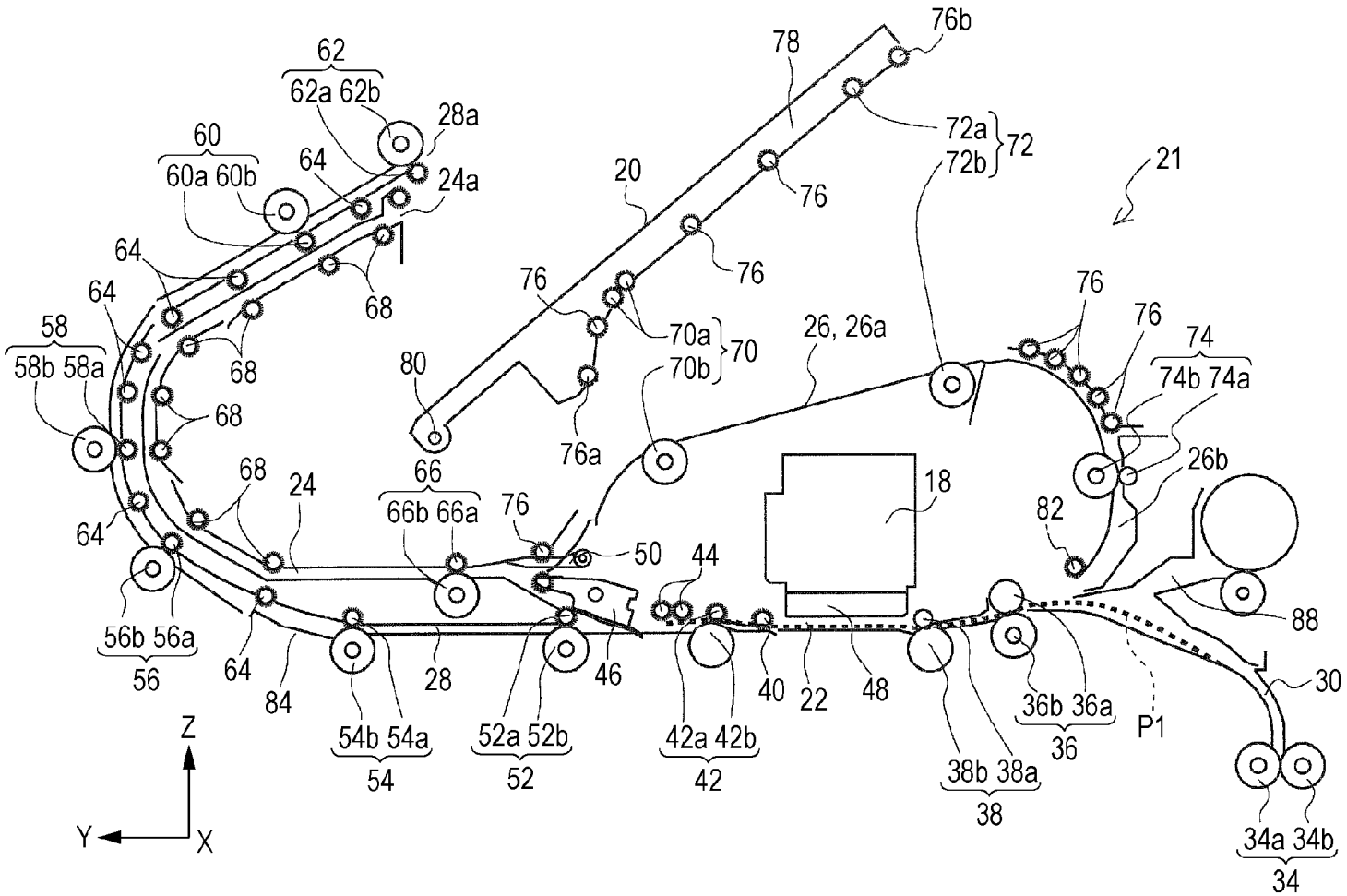
FIG. 21 is a view illustrating a state where an upper side member is moved rotationally and an upper portion section is exposed in the medium transporting path.
Figure 22:
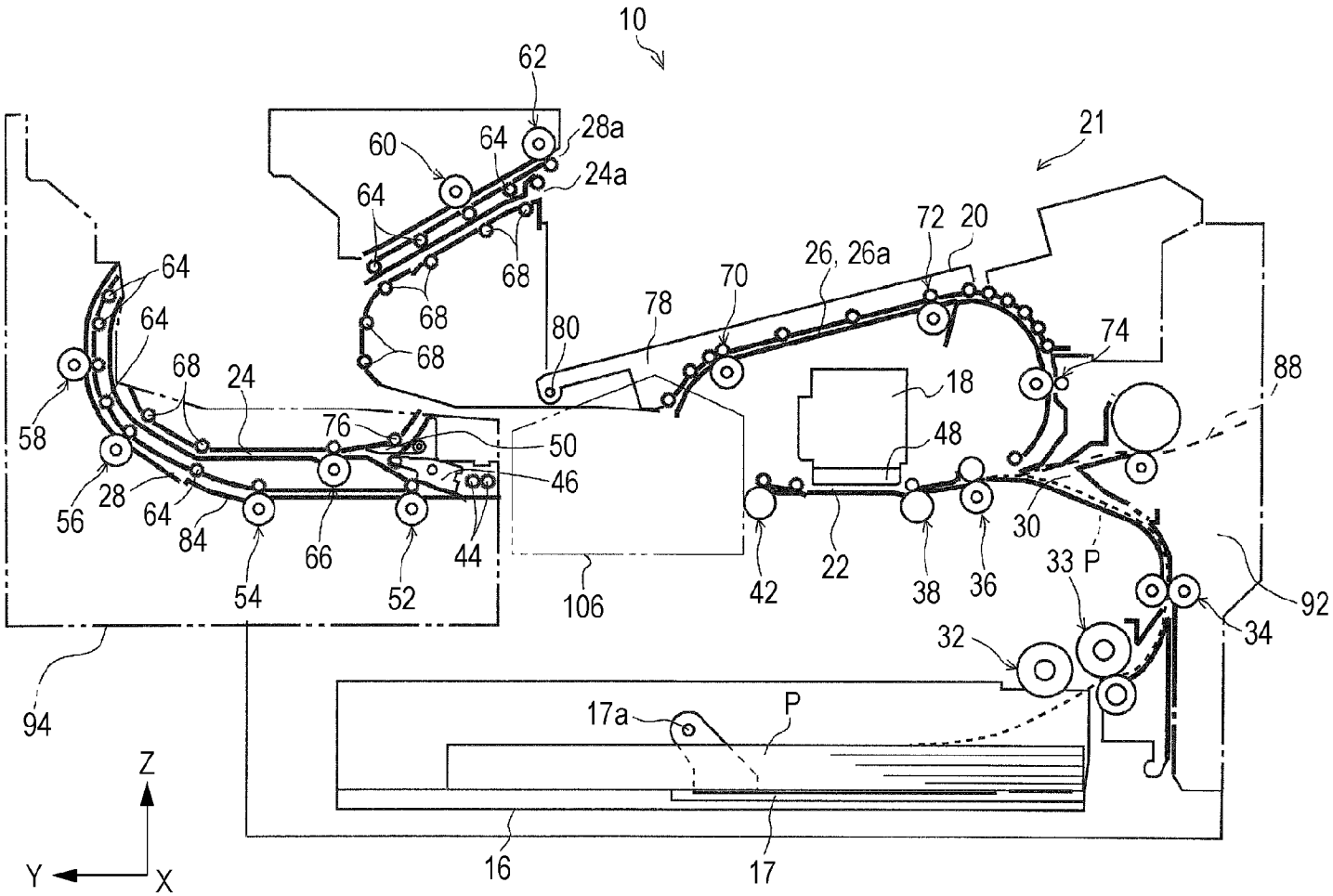
FIG. 22 is a view illustrating the second state where the unit body opens the medium transporting path in the medium transporting path.

FIG. 16 is a view illustrating a third state of the transported medium in the medium transporting path. FIG. 17 is a view illustrating a fourth state of the transported medium in the medium transporting path. FIG. 18 is a view illustrating a fifth state of the transported medium in the medium transporting path. FIG. 19 is a view illustrating a sixth state of the transported medium in the medium transporting path. FIG. 20 is a view illustrating a state where an opening/closing unit is detached from the medium transporting path. FIG. 21 is a view illustrating a state where an upper side member is moved rotationally and an upper portion section is exposed in the medium transporting path. FIG. 22 is a view illustrating the second state where the unit body opens the medium transporting path in the medium transporting path.

In an X-Y-Z coordinate illustrated in each drawing, an X direction is a depth direction of a recording apparatus and a width direction of the medium, a Y direction is a width direction of the recording apparatus and a transporting direction of the medium, and a Z direction is an apparatus height direction. Furthermore, in each drawing, a −X direction side is an apparatus front surface side, and a +X direction side is an apparatus rear surface side.

Overview of Printer and Transporting Path

An ink jet printer 10 (hereinafter, referred to as a printer 10) will be described as an example of a recording apparatus with reference to FIGS. 1 and 2. The printer 10 is configured as a multifunction printer which is provided with an apparatus main body 12 and a scanner unit 14. The apparatus main body 12 is provided with a plurality of medium accommodation cassettes 16 which accommodates the medium. Each medium accommodation cassette 16 is attached to be detachable from a front surface side (−X axis direction side in FIG. 1) of the apparatus main body 12. Furthermore, a medium P in the specification indicates a paper sheet, such as a plain paper sheet, cardboard, or a photo paper sheet.

In addition, in the apparatus height direction (Z axis direction) in the apparatus main body 12, between the scanner unit 14 and the medium accommodation cassette 16, a medium receiving tray 20 which receives the medium P on which recording is performed in a recording portion 18 which will be described later is provided.

With reference to FIGS. 2 and 14, a transporting path of the medium P in the printer 10 will be described. Furthermore, in FIG. 2, only main configuration elements of the transporting path of the medium P are given reference numerals, and in particular, the reference numerals of a plurality of provided spurs will be omitted. Meanwhile, in FIG. 14, detail configuration elements of the transporting path of the medium P will be given the reference numerals.

The printer 10 in the embodiment is provided with a medium transporting path 21. The medium transporting path 21 is configured of a straight path 22 as a "first transporting path", a switching-back path 24 as a "second transporting path", a reversing path 26 as a "third transporting path", a face-down discharge path 28 as a "fourth transporting path", and a feeding path 30 which is connected to the straight path 22 from the medium accommodation cassette 16.

In the feeding path 30, a feeding roller 32, a separation roller pair 33, and a first transporting roller pair 34 are provided in order along the transporting direction of the medium P. The feeding roller 32 is driven to be rotated by a driving source which is not illustrated. One roller 33*a* of the separation roller pair 33 is a roller which is rotated in a driven manner in a state where predetermined rotational resistance is applied, and performs separation of the medium P by nipping the medium P between the other roller 33*b* (a roller which is driven to be rotated) and one roller 33*a*.

One roller 34*a* of the first transporting roller pair 34 is configured as a driven roller which is rotated in a driven manner according to rotation driving of the other roller 34*b*. The other roller 34*b* is configured as driving roller which is driven to be rotated by the driving source which is not illustrated.

Furthermore, in the embodiment, one roller 34*a* and the other roller 34*b* of the first transporting roller pair 34 are configured of rubber rollers. In addition, each of the driving rollers is controlled by a control portion (not illustrated) provided in the apparatus main body 12 via the driving source which is not illustrated. In addition, a recording head 48 which will be described later is also controlled by the control portion. In other words, the control portion is configured to be able to perform necessary control in a recording operation in the printer 10.

Furthermore, in the description below, it is described that one roller in each transporting roller pair illustrated in the specification is configured as the driven roller, and the other roller is configured as the driving roller which is driven to be rotated by the driving source which is not illustrated. In addition, in the embodiment, when there is no specific description, one roller is configured as the spur which is provided with a plurality of teeth on an outer circumference, and the driving roller which is the other roller is configured as the rubber roller, for example.

As illustrated in FIG. 2, the medium P accommodated in the medium accommodation cassette 16 is supported on a hopper 17 provided in the medium accommodation cassette 16. The hopper 17 moves rotationally by considering a rotating shaft 17*a* provided in the hopper 17 as a fulcrum, and lifts up the medium P to the above. At this time, the feeding roller 32 comes into contact with the uppermost medium P among the media P supported by the hopper 17, and transports the medium P to the downstream side of the transporting direction. At this time, there is a case where the media P following the uppermost medium P is also transported together with the uppermost medium P. However, the uppermost medium P and the media P following the uppermost medium P are separated from each other by the separation roller pair 33, and only the uppermost medium P is transported to the downstream side of the transporting direction.

Hereinafter, the description will refer to FIG. 14. Furthermore, in the embodiment, in the description, it is assumed that there is the face-down discharging operation which discharges the medium by considering the recording surface of the medium P as a lower surface toward the medium receiving tray 20. On the downstream side of the transporting direction of the first transporting roller pair 34, a second transporting roller pair 36 is provided. The second transporting roller pair 36 is also provided with one roller 36*a* and the other roller 36*b*.

At a position of the second transporting roller pair 36 in the embodiment, the feeding path 30 and the straight path 22 are connected to each other. In other words, the feeding path 30 is set as a path from the medium accommodation cassette 16 to the second transporting roller pair 36.

The straight path 22 is configured as a path which extends in a straight line shape, and is provided with the second transporting roller pair 36, a third transporting roller pair 38, the recording portion 18, a spur 40, a fourth transporting roller pair 42, a spur 44, and a first flap 46 in order along the transporting direction. Furthermore, the straight path 22 in the embodiment is set as a path from the second transporting roller pair 36 to the first flap 46. In other words, the straight path 22 is set as a path which passes through the recording portion 18 and extends to the upstream side and the downstream side of the recording portion 18.

The third transporting roller pair 38 is provided with one roller 38*a* and the other roller 38*b*. Next, the recording portion 18 is provided with the recording head 48. When the medium P is transported to a position which faces the recording head 48, the recording head 48 in the embodiment is configured to eject ink onto the recording surface of the medium P and performs recording. The recording head 48 according to the embodiment is a recording head in which a nozzle which ejects the ink is provided to cover the entire paper sheet in the width direction, and is configured as a recording head which can perform recording on the entire paper sheet in the width direction, not following the movement in a paper sheet width direction.

In the transporting path on the downstream side of the recording portion 18, that is, the recording head 48, on a side which faces the recording surface of the medium P, the spur 40, one roller 42*a* (spur) of the fourth transporting roller pair 42, and the spur 44 are provided to be rotatable. In other words, as paper guiding is performed by these spurs on the recording surface of the medium P, it is possible to reduce a contact area on the recording surface, to control transfer to or white spots on the recording surface, and to control deterioration of recording quality.

Next, the first flap 46 is positioned on the downstream side of the transporting direction of the spur 44. By a driving mechanism which is controlled by the control portion (not illustrated) provided in the apparatus main body 12, the first flap 46 is configured to be able to switch to connect the straight path 22 and the switching-back path 24 to each other (state in FIG. 14), or to connect the straight path 22 and the face-down discharge path 28 to each other (state in FIG. 16). Furthermore, the driving mechanism which drives the first flap 46 in the embodiment is configured of a solenoid. In addition, the switching operation of a posture of the first flap 46 is controlled by the control portion (not illustrated).

In other words, when the straight path 22 and the switching-back path 24 are connected to each other by the first flap 46, the medium P is sent to the switching-back path 24 from the straight path 22 by the fourth transporting roller pair 42 (refer to FIG. 3). In addition, when the straight path 22 and the face-down discharge path 28 are connected to each other, the medium P is sent to the face-down discharge path 28 from the straight path 22 by the fourth transporting roller pair 42 (refer to FIG. 19).

Furthermore, here, a second flap 50 will be described. The second flap 50 is provided above the first flap 46 in the apparatus height direction (Z axis direction). The second flap 50 is interlocked with the operation of the first flap 46 and is driven by an interlocking mechanism which is not illustrated. In other words, the second flap 50 is controlled by the control portion via the first flap 46 and the interlocking mechanism.

When describing specific operations, in a state where the first flap 46 connects the straight path 22 and the switching-back path 24 to each other (refer to FIG. 14), the second flap 50 has a posture of blocking the connection between the switching-back path 24 and the reversing path 26. Meanwhile, in a state where the first flap 46 connects the straight path 22 and the face-down discharge path 28 to each other as illustrated in FIG. 16, the second flap 50 has a posture of connecting the switching-back path 24 and the reversing path 26 to each other.

The face-down discharge path 28 will be described with reference to FIG. 14 again. The face-down discharge path 28 extends to the upper side from the straight path 22 in the apparatus height direction, and is bent and reversed. The face-down discharge path 28 is provided with a fifth transporting roller pair 52, a sixth transporting roller pair 54, a seventh transporting roller pair 56, an eighth transporting roller pair 58, a ninth transporting roller pair 60, a tenth transporting roller pair 62, and a plurality of spurs 64.

The face-down discharge path 28 is a path from the first flap 46 to an outlet 28*a* which is positioned on the downstream side of the transporting direction of the tenth transporting roller pair 62. In other words, the face-down discharge path 28 is a transporting path which is connected to the straight path 22, and is a path which bends, reverses, and discharges the medium P which passes through the recording portion 18.

The medium P in which recording is performed on the recording surface in the recording portion 18 is transported to be nipped by the fifth transporting roller pair 52, the sixth transporting roller pair 54, the seventh transporting roller pair 56, the eighth transporting roller pair 58, the ninth transporting roller pair 60, and the tenth transporting roller pair 62 in order along the transporting direction from the first flap 46 in the face-dawn discharge path 28. Then, the medium P is discharged from the outlet 28*a* toward the medium receiving tray 20.

Here, when the medium P is transported in the face-down discharge path 28, the medium P is transported by considering the recording surface on which the final recording is performed by the recording portion 18 as an upper surface, then, the medium P is transported by bending the recording surface toward an inner side of a bent part of the face-down discharge path 28, and the medium P is discharged from the outlet 28*a* by considering the recording surface as a lower surface toward the medium receiving tray 20.

In addition, one roller 52*a* of the fifth transporting roller pair 52, one roller 54*a* of the sixth transporting roller pair 54, one roller 56*a* of the seventh transporting roller pair 56, one roller 58*a* of the eighth transporting roller pair 58, one roller 60*a* of the ninth transporting roller pair 60, one roller 62*a* of the tenth transporting roller pair 62, and a plurality of spurs 64 are disposed on the inner side of the bent part of the face-down discharge path 28, that is, on a side which faces the recording surface on which the final recording is performed in the recording portion 18.

Furthermore, the other roller 52*b* of the fifth transporting roller pair 52, the other roller 54*b* of the sixth transporting roller pair 54, the other roller 56*b* of the seventh transporting roller pair 56, the other roller 58*b* of the eighth transporting roller pair 58, the other roller 60*b* of the ninth transporting roller pair 60, and the other roller 62*b* of the tenth transporting roller pair 62 are disposed on the outer side of the bent part of the face-down discharge path 28, that is, on a side opposite to the side which faces the recording surface on which the final recording is performed in the recording portion 18.

In other words, when the medium P is transported, the plurality of spurs which are disposed on the inner side of the bent part of the face-down discharge path 28 comes into contact with the recording surface on which the final recording is performed in the recording portion 18. Therefore, it is possible to suppress contact with the recording surface to a minimum, and to suppress deterioration of recording quality of the medium P.

Here, the medium receiving tray 20 will be described with reference to FIG. 2 again. The medium receiving tray 20 has an upwardly inclined posture, which is an upward (+Z axis direction) posture toward a side far from the outlet 28*a* of the face-down discharge path 28, that is, a −Y axis direction side. The medium receiving tray 20 is configured to have the medium P discharged from the face-down discharge path 28 mounted thereon. Furthermore, the medium receiving tray 20 in the embodiment is disposed above the recording portion 18 in the Z axis direction, that is, on a +Z axis direction side.

Next, the switching-back path 24 will be described with reference to FIG. 14 again. After recording is performed on the first surface in the medium P, when recording is performed on a second surface, that is, when recording is performed on both surfaces, the switching-back path 24 and the reversing path 26 are paths through which the medium P passes. Furthermore, similarly, when recording is performed not on the first surface but on the second surface, the medium P passes through the switching-back path 24 and the reversing path 26. In other words, recording on both surfaces in the specification means that recording is performed on the second surface by reversing the medium P regardless of whether or not recording is performed on the first surface.

The switching-back path 24 is positioned on the inner side of the face-down discharge path 28 which is bent and reversed upwardly in the apparatus height direction, and extends along the face-down discharge path 28. The switching-back path 24 is provided with an eleventh transporting roller pair 66 and a plurality of spurs 68. One roller 66*a* of the eleventh transporting roller pair 66 and the plurality of spurs 68 are disposed on an inner side of the switching-back path 24 in a bending direction. In addition, the other roller 66*b* of the eleventh transporting roller pair 66 is disposed on an outer side of the switching-back path 24 in the bending direction.

In addition, in the embodiment, the switching-back path 24 is set as a path from the second flap 50 to an opening 24*a* which is provided at a tip end of the switching-back path 24. As illustrated in FIGS. 3 and 14, when the switching-back path 24 and the straight path 22 are connected to each other by the first flap 46, the medium P is sent into the switching-back path 24 through the first flap 46 from the recording portion 18 by the fourth transporting roller pair 42. The medium P is sent to a position at which a rear end portion in the transporting direction in the switching-back path 24 is nipped by the eleventh transporting roller pair 66.

Furthermore, at this time, there is a case where a length of the medium P in the transporting direction is longer than a length of the switching-back path 24. In this case, the tip end side of the medium P is in a state of being exposed to the outer side of the apparatus main body 12 as a tip end part of the medium P protrudes from the opening 24*a* provided at the tip end of the switching-back path 24. When the medium P is sent into the reversing path 26, the tip end part of the medium P protruded from the opening 24*a* is drawn into the switching-back path 24 from the opening 24*a*. Therefore, it is possible to respond to a case where the length of the medium P in the transporting direction is longer than the length of the switching-back path 24.

In addition, when the posture in a state where the first flap 46 connects the straight path 22 and the switching-back path 24 to each other (refer to FIG. 14) is switched to the posture in a state where the first flap 46 disconnects the straight path 22 and the switching-back path 24 from each other (refer to FIG. 16), the posture is switched to a posture in a state where the second flap 50 connects the switching-back path 24 and the reversing path 26 to each other (refer to FIGS. 4 and 16).

Accordingly, the control unit rotates the eleventh transporting roller pair 66 in a direction reverse to a direction in which the medium P is sent into the switching-back path 24, and sends out the medium P to the reversing path 26 by considering the rear end side of the medium P as the tip end side. In other words, the medium P is switched back. Therefore, the switching-back path 24 is a transporting path which is connected to the straight path 22, and is a path which transports the medium P in the direction reverse to the direction in which the medium P is switched back and sent after the medium P which passes through the recording portion 18 is sent.

Next, the reversing path 26 will be described with reference to FIG. 14. The reversing path 26 is set as a path which passes through the above of the recording portion 18 from the second flap 50, and reaches the second transporting roller pair 36 of the straight path 22.

The reversing path 26 is provided with a twelfth transporting roller pair 70, a thirteenth transporting roller pair 72, a fourteenth transporting roller pair 74, and a plurality of spurs 76. The other roller 70*b* of the twelfth transporting roller pair 70, the other roller 72*b* of the thirteenth transporting roller pair 72, and the other roller 74*b* of the fourteenth transporting roller pair 74 in the reversing path 26 are provided on the inner side of the transporting path with respect to the recording portion 18, that is, near the recording portion 18. In addition, one roller 70*a* of the twelfth transporting roller pair 70, one roller 72*a* of the thirteenth transporting roller pair 72, and the spurs 76 are provided on the outer side of the transporting path.

In addition, in the embodiment, a part from a spur which is given a reference numeral 76*a* to a spur which is given a reference numeral 76*b* through the twelfth transporting roller pair 70 and the thirteenth transporting roller pair 72, is considered as an upper portion section 26*a*, and a part from the spur which is given the reference numeral 76*b* to the second transporting roller pair 36, is considered as a reversing portion 26*b*.

The upper portion section 26*a* is provided with an upper side member 78 (refer to FIG. 2) which is a path forming member that forms the upper portion section 26*a*. The upper side member 78 is positioned on an upper side of the upper portion section 26*a*, and the medium receiving tray 20 is formed on the upper portion thereof. In other words, an upper surface of the upper side member 78 constitutes the medium receiving tray 20, and a lower surface of the upper side member 78 constitutes a part of the upper portion section 26*a*. In other words, the upper side member 78 is formed to be integrated with the medium receiving tray 20.

In addition, in the reversing path 26, the spurs 76, 76*a*, and 76*b* which are positioned in the upper portion section 26*a*, one roller 70*a* of the twelfth transporting roller pair 70, and one roller 72*a* of the thirteenth transporting roller pair 72 are attached to the upper side member 78 to be rotatable.

In addition, as illustrated in FIG. 2, in the upper side member 78, a rotation fulcrum 80 is provided in a +Y axis direction side end portion. Therefore, the upper side member 78 can obtain a posture in which the upper portion section 26*a* is closed (refer to a solid line portion in FIG. 2) and a posture in which the upper portion section 26*a* is opened (refer to a two dot chain line portion in FIG. 2). Furthermore, rotational movement of the upper side member 78 will be described later in detail.

With reference to FIG. 14 again, the upper portion section 26*a* in the reversing path 26 is inclined upwardly (+Z axis direction) and extends in a −Y axis direction. In other words, the upper portion section 26*a* extends along the medium receiving tray 20 (refer to FIG. 2). As a result, it is possible to reduce a curvature of a part in which the medium is bent and reversed in the reversing portion 26*b*, that is, a reversed part, and to smoothly transport the medium P since it is not necessary to bend the medium P forcibly.

An outlet side of the reversing portion 26*b* is configured to converge with the straight path 22 at an upstream position of the second transporting roller pair 36 in the straight path 22. Then, the medium P is sent into the straight path 22 again. In other words, the reversing path 26 is a transporting path which is connected to the switching-back path 24, and is set as a path which allows the medium P which is transported in the reverse direction, that is, the medium P which is switched back to bypass the upper side of the recording portion 18, to be reversed, and to be converged by the second transporting roller pair 36 which is positioned at the upstream side position of the recording portion 18 in the straight path 22.

Here, when the medium P is converged with the straight path 22 from the reversing path 26, skew-removing is performed. In the embodiment, one roller 74*a* of the fourteenth transporting roller pair 74 is configured as a resin roller. In addition, in a path between the second transporting roller pair 36 and the fourteenth transporting roller pair 74, a spur 82 is provided to be rotatable on the inner side of the transporting path.

In other words, as the medium P which is transported along the reversing path 26 is nipped by the fourteenth transporting roller pair 74, and the tip end of the medium P butts against the second transporting roller pair 36, skew-removing is performed. At this time, the spur 82 suppresses a scratch generated between the medium which is bent when skew-removing is performed and the path forming member in the reversing path 26.

Above, an overview of the medium transporting path when the face-down discharge is performed with respect to the medium receiving tray 20 in the printer 10 is described. In the embodiment, when recording on both surfaces with respect to the medium P, that is, recording on the first surface and the second surface of the medium P, is performed in the printer 10, the transporting path of the medium P goes through the straight path 22, the recording portion 18, the switching-back path 24, and the reversing path 26 from the medium accommodation cassette 16, passes through the straight path 22 and the recording portion 18 again, and reaches the medium receiving tray 20 through the face-down discharge path 28.

In addition, the printer 10 in the embodiment is also configured to be able to perform a face-up discharge. A part of the path forming member between the other roller 54*b* of the sixth transporting roller pair 54 and the other roller 56*b* of the seventh transporting roller pair 56 in the face-down discharge path 28 is configured as a third flap 84. The third flap 84 is configured to be able to switch a posture (refer to FIGS. 2 and 14) which constitutes the transporting path of the face-down discharge path 28 to a face-up discharge posture (not illustrated). Furthermore, the third flap 84 in the embodiment is controlled by the control portion.

As the third flap 84 switches the posture to the face-up discharge posture, the medium P which is sent to the face-down discharge path 28 from the straight path 22 is discharged by considering the recording surface of the medium P as the upper surface to a face-up discharge tray 86 illustrated in FIG. 8 via the third flap 84.

In addition, a dotted line which is given a reference numeral 88 in FIG. 2 illustrates a manual feeding path of the medium P which is supplied from a manual tray 90 in a state where the manual tray 90 (refer to FIG. 1) is moved rotationally with respect to the apparatus main body 12 and opened. The manual feeding path 88 is configured to be converged with the feeding path 30. Accordingly, the medium P which is supplied from the manual feeding path 88 is also configured to be able to perform both recording on one surface and recording on both surfaces in the printer 10. Furthermore, a posture in which the manual tray 90 is opened with respect to the apparatus main body 12 is omitted in the drawing.

Regarding Transporting Plurality of Media in Printer

Next, with reference to FIGS. 14 to 19, transporting of the medium in the medium transporting path when recording is performed on both surfaces of a plurality of media Pn in the printer 10 will be described. Furthermore, in FIGS. 14 to 19, a dotted line which is given a reference numeral P1 is a medium which is transported first in the transporting path, a dotted line which is given a reference numeral P2 is a medium which is transported second, and a dotted line which is given a reference numeral P3 is a medium which is transported third.

The medium P1, which is sent along the feeding path 30 by the feeding roller 32 (refer to FIG. 2) from the medium accommodation cassette 16 (refer to FIG. 2) as illustrated in FIG. 14, is transported to a position which faces the recording portion 18 which is nipped by the second transporting roller pair 36 and the third transporting roller pair 38 in order, that is, the recording head 48. Then, recording is performed on a first surface of the medium P1 in the recording portion 18. The medium P1 in which recording is performed on the first surface is nipped by the fourth transporting roller pair 42, and is transported toward the first flap 46 which is at a position on the downstream side of the transporting direction of the fourth transporting roller pair 42.

At this time, the first flap 46 obtains a posture in which the straight path 22 and the switching-back path 24 are connected to each other. Then, as illustrated in FIG. 15, the medium P1 is sent into the switching-back path 24 through the first flap 46 by the fourth transporting roller pair 42.

Then, the medium P1 is sent along the switching-back path 24 to a position at which a rear end of the medium P1 which is nipped by the eleventh transporting roller pair 66 does not interfere with the second flap 50. At this time, the secondary medium P2 is sent out to the feeding path 30 from the medium accommodation cassette 16 by the feeding roller 32.

Next, as illustrated in FIG. 16, the control portion (not illustrated) has a function of switching the posture of the first flap 46, and connecting the straight path 22 and the face-down discharge path 28 to each other. As a result, the second flap 50 interlocks with the operation of the first flap 46, and obtains a posture in which the switching-back path 24 and the reversing path 26 are connected to each other. Then, the eleventh transporting roller pair 66 is driven to be rotated by control of the control portion in the direction reverse to the direction in which the medium P1 is sent into the switching-back path 24. As a result, by considering the rear end side of the transporting direction when the medium P1 is sent into the switching-back path 24 as the tip end side of the transporting direction, the medium P1 is sent out to the reversing path 26. In other words, the medium P1 is switched back. At this time, recording is performed on the first surface of the medium P2 in the recording portion 18.

Next, as illustrated in FIG. 17, the medium P1 is nipped by the twelfth transporting roller pair 70 and the thirteenth transporting roller pair 72 in order, and is transported to the upper portion section 26*a* which is positioned above the recording portion 18 in the reversing path 26. Furthermore, if the medium P1 passes through the second flap 50, the posture of the first flap 46 is switched, and the straight path 22 and the switching-back path 24 are connected to each other again.

The medium P2 in which recording on the first surface is finished in the recording portion 18 is transported to the switching-back path 24 through the fourth transporting roller pair 42, the first flap 46, and the eleventh transporting roller pair 66. Furthermore, according to the posture switch of the first flap 46, the second flap 50 switches a posture to a posture in which the switching-back path 24 and the reversing path 26 are disconnected from each other.

Next, as illustrated in FIG. 18, when the medium P1 is transported along the reversing portion 26*b* of the reversing path 26, the first surface and the second surface are reversed to each other, and the medium P1 is nipped by the fourteenth transporting roller pair 74 and transported toward the straight path 22. At this time, the tip end of the medium P butts against the second transporting roller pair 36 and skew-removing is performed. Then, the medium P1 is sent into the straight path 22 as the second surface faces toward the side which faces the recording head 48 of the recording portion 18. The medium P1 which is sent into the straight path 22 is nipped by the second transporting roller pair 36 and the third transporting roller pair 38 in order, and transported to the recording portion 18.

Then, recording is performed on the second surface of the medium P1 in the recording portion 18. Furthermore, the first flap 46 is provided in discharging the medium P1, and switches the posture in which the straight path 22 and the switching-back path 24 are connected to each other to the posture in which the straight path 22 and the face-down discharge path 28 are connected to each other, by the control portion. In addition, the second flap 50 is also interlocked with the first flap 46, and switches the posture in which the switching-back path 24 and the reversing path 26 are disconnected from each other to the posture in which the switching-back path 24 and the reversing path 26 are connected to each other.

Next, as illustrated in FIG. 19, the medium P1 in which recording is performed on the second surface in the recording portion 18 is transported to the face-down discharge path 28 by the fourth transporting roller pair 42. The medium P1 is nipped by the fifth transporting roller pair 52, the sixth transporting roller pair 54, the seventh transporting roller pair 56, the eighth transporting roller pair 58, the ninth transporting roller pair 60, and the tenth transporting roller pair 62 in order in the face-down discharge path 28, is transported to the downstream side of the transporting direction, and is discharged toward the medium receiving tray 20 from the outlet 28*a* of the face-down discharge path 28 by considering a surface on which the final recording is performed, that is, the second surface, as the lower surface.

Furthermore, at this time, the medium P2 is sent into the reversing path 26 from the switching-back path 24 by the eleventh transporting roller pair 66. Then, the third medium P3 enters the straight path 22, and is transported to the recording portion 18. Then, recording is performed on a first surface of the medium P3 in the recording portion 18.

Then, the medium P3 is sent into the switching-back path 24 by the fourth transporting roller pair 42 and the eleventh transporting roller pair 66 through the first flap 46 which switches the posture in which the straight path 22 and the face-down discharge path 28 are connected to each other to the posture in which the straight path 22 and the switching-back path 24 are connected to each other. Furthermore, if the medium P3 passes through the first flap 46, the posture is switched again. Then, recording is performed on a second surface of the medium P3 sent from the reversing path 26 in the recording portion 18, and the medium P3 passes through the face-down discharge path 28 and is discharged to the medium receiving tray 20.

After this, until recording is performed on the second surface of the predetermined number of media Pn, the medium Pn is discharged to the medium receiving tray 20, and the recording operation is finished, after recording is performed on the first surface of the medium Pn−1 in the recording portion 18, while the medium Pn−1 is transported to the switching-back path 24 and the reversing path 26, recording is performed on the first surface of the medium Pn in the recording portion 18. After this, the medium Pn is transported to the switching-back path 24 from the straight path 22.

Then, after the medium Pn is transported to the switching-back path 24, the operations of recording on the second surface of the medium Pn−1 in the recording portion 18, and discharging the medium Pn−1 to the medium receiving tray 20 from the face-down discharge path 28, are repeated. Above, transporting of the medium in the medium transporting path 21 when recording is performed on both surfaces of the plurality of media Pn in the printer 10 is described.

In other words, the medium transporting path 21 in the embodiment is provided with the switching-back path 24 along the face-down discharge path 28, and is provided so that the reversing path 26 which is connected to the switching-back path 24 moves around the circumference of the recording portion 18. For this reason, it is possible to respectively transport three media P at the same time in the medium transporting path 21, and to perform recording in order. Therefore, it is possible to improve the number of media on which recording process is performed per unit time. In other words, it is possible to improve throughput in the printer 10.

In summarizing the description above, the printer 10 in the embodiment includes: the straight path 22 which is a transporting path that transports the medium P, passes through the recording portion 18 that performs recording on the medium P, and extends to the upstream side and the downstream side of the recording portion 18; the switching-back path 24 which is a transporting path that is connected to the straight path 22, and switches back and transports the medium P in the direction reverse to the sending direction, after sending the medium P that passes through the recording portion 18; the reversing path 26 which is a transporting path that is connected to the switching-back path 24, and allows the medium P transported in the reverse direction to bypass the upper side of the recording portion 18, to be reversed, and to be converged at the upstream side position of the recording portion 18 in the straight path 22; and the face-down discharge path 28 which is a transporting path that is connected to the straight path 22, and bends, reverses, and discharges the medium P which passes through the recording portion 18. The switching-back path 24 is formed along the face-down discharge path 28.

In other words, after the medium P which passes through the recording portion 18 is sent, the switching-back path 24 which switches back and transports the medium P in the direction reverse to the sending direction is formed along the face-down discharge path 28 which bends, reverses, and discharges the medium P which passes through the recording portion 18. For this reason, the switching-back path 24 and the face-down discharge path 28 do not occupy a region individually and independently in the printer 10, and it is possible to further reduce a size of the apparatus.

In addition, the switching-back path 24 and the face-down discharge path 28 in the embodiment are positioned on the reversing path 26 side with respect to the straight path 22.

Here, in summarizing the description regarding a positional relationship of the straight path 22, the switching-back path 24, the reversing path 26, and the face-down discharge path 28, the switching-back path 24 and the face-down discharge path 28 are positioned on the reversing path 26 side with respect to the straight path 22 in the apparatus height direction. Therefore, the switching-back path 24, the reversing path 26, and the face-down discharge path 28 use at least a part of the same region in the apparatus height direction in the printer 10, and thus, it is possible to more efficiently increase the dimension in the apparatus height direction.

In addition, in the embodiment, as illustrated in FIG. 2, in the occupied region of the face-down discharge path 28 in the height direction, the switching-back path 24 and the face-down discharge path 28 are fitted.

In other words, the switching-back path 24 and the reversing path 26 do not independently occupy the region in the apparatus height direction, and it is possible to further reduce the size of the apparatus.

In addition, the switching-back path 24 in the embodiment is disposed on the inner side of the face-down discharge path 28.

As a result, a path toward the reversing path 26 from the switching-back path 24 and a path toward the face-down discharge path 28 from the straight path 22 do not intersect each other, and it is possible to improve a degree of freedom of control when recording, and further, to improve throughput.

The printer 10 in the embodiment is provided with the medium receiving tray 20 which receives the medium P discharged from the face-down discharge path 28, above the recording portion 18. The medium receiving tray 20 obtains the upwardly inclined posture, which is an upward posture toward a side far from the outlet 28*a* of the face-down discharge path 28. In addition, the reversing path 26 is reversed after being inclined upwardly along the upwardly inclined posture of the medium receiving tray 20, and is converged with the straight path 22.

As a result, it is possible to reduce a curvature of the reversed part in the reversing path 26, and to smoothly reverse the medium without applying a force.

In addition, the switching-back path 24 in the embodiment is bent by considering the first surface which faces the recording head 48 which constitutes the recording portion 18 in the medium P that passes through the straight path 22 as the inner side.

Here, when recording is performed on both surfaces (the first surface and the second surface) of the medium P, since the recording portion 18 has a configuration in which recording is performed by ejecting the ink as "liquid" onto the medium P, the medium P onto which the ink is ejected tends to be bent by considering a surface (recording surface) onto which the ink is ejected as the outer side (curl tendency). If the medium P is reversed in this manner, and is sent to the recording portion 18 again, since the medium P is bent by considering the surface which faces the recording head 48 as the inner side, the tip end or the rear end of the medium P is likely to be in contact with the recording head 48, that is, a so-called head scratch is likely to be generated.

However, in the embodiment, since the switching-back path 24 is bent by considering the first surface (that is, a surface on which recording is already performed) which faces the recording head 48 which constitutes the recording portion 18 in the medium P that passes through the straight path 22 as the inner side, that is, the switching-back path 24 is bent in a direction in which the curl tendency is corrected, it is possible to prevent or suppress the head scratch.

Regarding Configuration for Paper Jam Process in Apparatus Main Body

Next, a configuration for processing a paper jam of the medium P which is generated in the transporting path in the apparatus main body 12 will be described with reference to FIGS. 2, 5 to 13, and 20.

Jam Processing in Feeding Path and Reversing Portion 26*b*

With reference to FIG. 20, one dot chain line portion which is given a reference numeral 92 illustrates an opening/closing unit which can be opened and closed with respect to the apparatus main body. Furthermore, in FIG. 20, a state where the opening/closing unit 92 is moved in a horizontal direction from the medium transporting path 21 for the description is illustrated. The opening/closing unit 92 can obtain a state of being closed with respect to the apparatus main body 12 illustrated in FIG. 1, and a state of being opened with respect to the apparatus main body 12 illustrated in FIG. 5. The opening/closing unit 92 has a rotation fulcrum (not illustrated) at the end portion on a +X axis direction side. The opening/closing unit 92 is configured to be rotatable with respect to the apparatus main body 12 by considering the rotation fulcrum as a center (refer to FIGS. 1 and 5).

The opening/closing unit 92 is provided with the manual tray 90 which can be opened and closed with respect to the opening/closing unit 92. Furthermore, when the opening/closing unit 92 is closed with respect to the apparatus main body 12, the opening/closing unit 92 forms a path from the first transporting roller pair 34 in the feeding path 30 to a position at which the opening/closing unit 92 and the manual feeding path 88 are converged, and a part of the reversing portion 26*b* of the reversing path 26. In addition, the opening/closing unit 92 is provided with one roller of the fourteenth transporting roller pair 74, that is, the roller 74*a* which can be rotated in a driven manner.

Therefore, as illustrated in FIGS. 5 and 20, when the opening/closing unit 92 is in a state of being opened with respect to the apparatus main body 12, the path from the first transporting roller pair 34 in the feeding path 30 to the position at which the opening/closing unit 92 and the manual feeding path 88 are converged and a part of the reversing portion 26*b* of the reversing path 26, are exposed toward the outer side of the apparatus main body 12. At this time, as illustrated in FIG. 20, one roller 34*a* and the other roller 34*b* of the first transporting roller pair 34 are separated from each other, and a nipped state in the first transporting roller pair 34 is released. Therefore, it is possible to easily remove the jammed medium P in the feeding path 30. Therefore, it is possible to more easily perform jam processing.

Similarly, since one roller 74*a* and the other roller 74*b* of the fourteenth transporting roller pair 74 are separated from each other, the nipped state in the fourteenth transporting roller pair 74 is released. Therefore, it is possible to easily remove the jammed medium P in the reversing portion 26*b* of the reversing path 26. Therefore, it is possible to more easily perform the jam processing.

Jam Processing in Upper Portion Section 26*a* in Reversing Path 26

Next, the upper side member 78 will be described with reference to FIGS. 6, 7, and 21. A state of the upper side member 78 can be changed from a state (refer to FIG. 6) of being closed with respect to the apparatus main body 12 by considering the rotation fulcrum 80 (refer to FIG. 21) provided at the +Y axis direction side end portion as a fulcrum to a state (refer to FIG. 7) of being opened with respect to the apparatus main body 12 by being rotated to an upper side (+Z axis direction side).

When the state of the upper side member 78 is a state (refer to FIG. 21) of being opened with respect to the apparatus main body 12, the upper portion section 26*a* of the reversing path 26 is opened. In other words, the upper portion section 26*a* of the reversing path 26 is in a state of being exposed toward the outer side of the apparatus main body 12. In addition, one roller 70*a* (spur) and the other roller 70*b* of the twelfth transporting roller pair 70 which is disposed in the upper portion section 26*a* are respectively separated from each other, and a nipped state in the twelfth transporting roller pair 70 is released. Similarly, one roller 72*a* (spur) and the other roller 72*b* of the thirteenth transporting roller pair 72 disposed in the upper portion section 26*a* are respectively separated from each other, and a nipped state of the thirteenth transporting roller pair 72 is released.

In addition, since the spurs 76, 76*a*, and 76*b* which are disposed in the upper portion section 26*a* are provided in the upper side member 78, when the upper side member 78 is rotated, rollers which remain in the upper portion section 26*a* are only the other roller 70*b* (rubber roller) of the twelfth transporting roller pair 70 which supports the lower side of the medium P in the apparatus height direction and the other roller 72*b* (rubber roller) of the thirteenth transporting roller pair 72. Therefore, since there is no member which blocks the upper part of the upper portion section 26*a*, it is possible to easily perform the jam processing of the medium P.

In summarizing the description above, the printer 10 in the embodiment includes: the straight path 22 which is a transporting path that transports the medium P, passes through the recording portion 18 that performs recording on the medium P, and extends to the upstream side and the downstream side of the recording portion 18; the switching-back path 24 which is a transporting path that is connected to the straight path 22, and switches back and transports the medium P in the direction reverse to the sending direction, after sending the medium P that passes through the recording portion 18; the reversing path 26 which is a transporting path that is connected to the switching-back path 24, and allows the medium P transported in the reverse direction to bypass the upper side of the recording portion 18, to be reversed, and to be converged at the upstream side position of the recording portion 18 in the straight path 22; and the upper side member 78 which is a path forming member that forms the upper portion section 26*a* of the recording portion 18 in the reversing path 26, is positioned on the upper side of the upper portion section 26*a*, and can open the upper portion section 26*a*.

The reversing path 26 in the embodiment is configured as a path which allows the medium P to bypass the upper side of the recording portion 18, to be reversed, and to be converged at a position on the upstream side of the recording portion 18 in the straight path 22. In other words, the reversing path 26 is positioned above the recording portion 18. Since the upper portion section 26*a* of the recording portion 18 is formed by the upper side member 78 which can open the upper portion section 26*a*, by opening the upper side member 78, without moving the recording portion 18, or without being interrupted by the recording portion 18, it is possible to easily perform the jam processing operation of removing the jammed medium in the upper portion section 26*a*.

The upper portion section 26*a* is provided with the twelfth transporting roller pair 70 which nips and transports the medium P. As one roller 70*a* which constitutes the twelfth transporting roller pair 70 is provided in the upper side member 78, and the upper side member 78 is opened, one roller 70*a* which constitutes the twelfth transporting roller pair 70 is separated from the other roller 70*b*. Similarly, the upper portion section 26*a* is also provided with the thirteenth transporting roller pair 72 which nips and transports the medium P. As one roller 72*a* which constitutes the thirteenth transporting roller pair 72 is provided in the upper side member 78, and the upper side member 78 is opened, one roller 72*a* which constitutes the thirteenth transporting roller pair 72 is separated from the other roller 72*b*.

As a result, the nipped state of the medium P by one roller 70*a* and the other roller 70*b* of the twelfth transporting roller pair 70 is released. In addition, the nipped state of the medium P by one roller 72*a* and the other roller 72*b* of the thirteenth transporting roller pair 72 is also released. According to this, it is possible to more easily remove the jammed medium P.

In the embodiment, one roller 70*a* of the twelfth transporting roller pair 70 which is provided in the upper side member 78 is a roller which can be rotated in a driven manner, and the other roller 70*b* is a roller which can be driven to be rotated by the driving source. In addition, similarly, one roller 72*a* of the thirteenth transporting roller pair 72 which is provided in the upper side member 78 is also a roller which can be rotated in a driven manner, and the other roller 72*b* is a roller which is driven to be rotated by the driving source.

Therefore, since one roller 70*a* of the twelfth transporting roller pair 70 and one roller 72*a* of the thirteenth transporting roller pair 72 which are provided in the upper side member 78 are respectively the rollers which can be rotated in a driven manner, it is not required that a power transmission mechanism be provided in the upper side member 78, and thus, it is possible to avoid an increase in weight of the upper side member 78, and to easily open and close the upper side member 78 with a small amount of power.

One roller 70*a* of the twelfth transporting roller pair 70 and one roller 72*a* of the thirteenth transporting roller pair 72 which are provided in the upper side member 78 are serrated rollers (spurs) which have the plurality of teeth on the outer circumference, and the serrated rollers are in contact with the one surface of the medium P on which recording is already performed.

In other words, one roller 70*a* of the twelfth transporting roller pair 70 and one roller 72*a* of the thirteenth transporting roller pair 72 which are provided in the upper side member 78 are spurs (serrated rollers) which have the plurality of teeth on the outer circumference. Since the spurs are in contact with the one surface of the medium on which recording is already performed, it is possible to control transfer to or white spots on the recording surface.

The printer 10 includes: the medium receiving tray 20 which is positioned above the upper portion section 26*a* and receives the discharged medium P; and the face-down discharge path 28 which is a transporting path that is connected to the straight path 22, and transports the medium that passes through the recording portion 18 to the medium receiving tray 20. The medium receiving tray 20 is configured to be integrated with the upper side member 78, and can be opened and closed.

Therefore, as the medium receiving tray 20 in which a large opening/closing region is ensured and the upper side member 78 are configured to be integrated with each other, it is possible to more easily perform the jam processing operation in a state where the upper side member 78 is opened.

The medium receiving tray 20 obtains the upwardly inclined posture which is an upward posture toward a side far from the outlet 28*a* of the face-down discharge path 28 in a state of being closed, and can be opened and closed according to the rotational movement of the medium receiving tray 20. At the same time, the rotation fulcrum 80 when moving rotationally is positioned on the upstream side of the medium receiving tray 20.

Therefore, it is possible to ensure a large rotational movement range of the medium receiving tray 20 and the upper side member 78, and to open the upper side member 78 and more easily perform the jam processing operation.

Jam Processing in Switching-Back Path and Face-Down Discharge Path

As illustrated in FIG. 22, a two dot chain line portion which is given a reference numeral 94 in FIG. 22 illustrates a unit body which can obtain a first state where the medium transporting path 21 is formed with respect to the apparatus main body 12 and a second state where the medium transporting path 21 is opened. Furthermore, only the spurs which are related to the unit body 94 among the plurality of spurs provided in the medium transporting path 21 in FIG. 22 are given reference numerals, and reference numerals of other spurs are omitted.

The unit body 94 includes a path from the downstream side of the fourth transporting roller pair 42 in the straight path 22 to the first flap 46 and the second flap 50, and a path from the second flap 50 in the switching-back path 24 to the middle of the bent and reversed part via the eleventh transporting roller pair 66. Furthermore, the unit body 94 includes a path from the first flap 46 in the face-down discharge path 28 via the fifth transporting roller pair 52, the sixth transporting roller pair 54, the seventh transporting roller pair 56, and the eighth transporting roller pair 58, from the eighth transporting roller pair 58 to the middle of the path toward the ninth transporting roller pair 60.

The unit body 94 is configured to be movable in the Y axis direction, with respect to a structure body 96 which constitutes the medium transporting path 21 in the apparatus main body 12 as illustrated in FIG. 8. In the embodiment, the unit body 94 is configured to be able to be taken in and out from the structure body 96 by one pair of rail members 98 which is provided in the structure body 96.

Next, as illustrated in FIG. 9, a lever 100 is provided in an upper portion of the unit body 94. The lever 100 is configured to be able to be engaged with a lock mechanism which is not illustrated and provided in the apparatus main body 12. In a state (refer to FIG. 9) where the unit body 94 is closed with respect to the apparatus main body 12, that is, the first state where the unit body 94 forms the medium transporting path 21, the lever 100 is in a state of being engaged with the lock mechanism. According to this, the unit body 94 is in a state where the movement of the unit body 94 with respect to the apparatus main body 12 is limited.

Next, in a case of a configuration in which the engaged state between the lever 100 and the lock mechanism is released, for example, by lifting up the lever 100, it is possible to release the locked state by lifting up the lever 100, and to draw out the unit body 94 with respect to the apparatus main body 12 by pulling the lever 100. In other words, in a state where the engagement between the lever 100 and the lock mechanism is released, if the lever 100 is pulled to the +Y axis direction side of FIGS. 9 and 10, the unit body 94 is in a state of being drawn out from the apparatus main body 12 as illustrated in FIG. 10, that is, the second state where the medium transporting path 21 is opened.

As illustrated in FIG. 22, if the unit body 94 is in a state (second state) of being drawn out with respect to the apparatus main body 12, a part of the straight path 22, a part of the switching-back path 24, and a part of the face-down discharge path 28 are exposed toward the outer side of the apparatus main body 12. In particular, when a paper jam is generated in the switching-back path 24 and the face-down discharge path 28, it is possible to visually confirm the switching-back path 24 and the face-down discharge path 28, and to more easily perform the jam processing operation in these paths.

In addition, an opening/closing cover 102 (refer to FIG. 9) is provided in the unit body 94 to be rotatable with respect to the unit body 94. If the opening/closing cover 102 is in a state (not illustrated) of being opened with respect to the unit body 94, it is possible to expose the face-up discharge tray 86 which is provided in the unit body 94 toward the outer side of the apparatus main body 12, and to take out the medium P discharged to the face-up discharge tray 86 from the apparatus main body 12.

Jam Processing in Straight Path

Next, with reference to FIGS. 8, 11 to 14, and 22, the jam processing in the straight path 22 and in the transporting path in the vicinity thereof will be described.

As illustrated in FIG. 8, a frame 104 stands on the apparatus front surface side in the depth direction of the recording apparatus which is a direction that intersects the transporting direction of the medium in the structure body 96. The frame 104 is a frame which makes a frame of the structure body 96. In the frame 104, an opening 106 is formed. The opening 106 is formed at a position which corresponds to the fourth transporting roller pair 42, the fifth transporting roller pair 52, the sixth transporting roller pair 54, the eleventh transporting roller pair 66, the first flap 46, and the second flap 50 as illustrated in FIG. 14, in the first state of the unit body 94 in the frame 104 with respect to the structure body 96, that is, a state where the unit body 94 constitutes the medium transporting path 21. Furthermore, a two dot chain line portion which is given a reference numeral 106 in FIGS. 14 and 22 illustrates the opening.

In the second state of the unit body 94 with respect to the structure body 96 as illustrated in FIGS. 8 and 22, that is, a state where the unit body 94 is drawn out from the structure body 96 and opens the medium transporting path 21, a user can access a part of the recording portion 18 or the straight path 22 in the medium transporting path 21, for example, the fourth transporting roller pair 42 and the periphery thereof from a side of the medium transporting path 21, that is, the apparatus front surface side, via the opening 106. In addition, it is also possible to access an inlet of the switching-back path 24 or the face-down discharge path 28.

Here, if a case where the opening 106 is not provided in the frame 104 is considered, in order to access the straight path 22 which is at an innermost position in the structure body 96, for example, the fourth transporting roller pair 42 or the periphery thereof, access from the unit body 94 side which is drawn out from the structure body 96 is required. As a result, as an access distance to the vicinity of the straight path 22 or the recording portion 18 from the unit body 94 side becomes long, and it is difficult to visually confirm a state of paper jam, an operability of the jam processing operation extremely deteriorates.

In the embodiment, as the opening 106 is provided at a position which corresponds to the fourth transporting roller pair 42, the fifth transporting roller pair 52, the sixth transporting roller pair 54, the eleventh transporting roller pair 66, the first flap 46, and the second flap 50 in the medium transporting path 21 in the frame 104, that is, on the medium transporting path 21 side, in a state where the unit body 94 is drawn out from the structure body 96, that is, the second state, it is possible to access and to easily and visually confirm the recording portion 18 which is at the innermost position in the apparatus main body 12, the straight path 22, and further, the inlet of the switching-back path 24 or the face-down discharge path 28.

Furthermore, the jam processing operation in the periphery of the recording portion 18 and the straight path 22 in the opening 106 will be described in detail. As illustrated in FIGS. 9 and 11, at the position which corresponds to the structure body 96 in the apparatus height direction in the apparatus main body 12, that is, on the apparatus front surface side (−X axis direction side) of the frame 104, a front surface cover 108 which can be moved rotationally with respect to the apparatus main body 12 by considering the lower end portion as the rotation fulcrum is provided. By moving the front surface cover 108 rotationally with respect to the apparatus main body 12, the opening 106 is exposed toward the outer side of the apparatus main body 12.

In this state, the unit body 94 is accommodated in the structure body 96, and a part of the unit body 94 forms the medium transporting path 21. For this reason, the user cannot input a hand into the opening 106, and it is not possible to visually confirm the straight path 22 at the downstream side part of the recording portion 18 in the medium transporting path 21.

Next, with reference to FIGS. 12 and 13, when the lever 100 is operated, the locked state of the unit body 94 with respect to the apparatus main body 12 is released, and the unit body 94 is drawn out from the apparatus main body 12, a part of the unit body 94 which blocks the opening 106 moves in the +Y axis direction. As a result, the straight path 22 which is at the innermost position in the apparatus main body 12 on the inner side of the opening 106, for example, the fourth transporting roller pair 42 and the vicinity thereof which are positioned on the downstream side of the recording portion 18, are visually confirmed. Then, the user can input the hand into the medium transporting path 21 via the opening 106, and the jam processing can be performed.

Furthermore, when the unit body 94 is drawn out from the structure body 96, one roller (a roller which can be rotated in a driven manner) 42*a* in the fourth transporting roller pair 42 is separated from the other roller (driving roller) 42*b* by the interlocking mechanism which is not illustrated, and the nipped state in the fourth transporting roller pair 42 is released. According to this, it is possible to easily perform processing of the jam (paper jam) which is generated in the recording portion 18.

In summarizing the description above, the printer 10 in the embodiment includes: the recording portion 18 which performs recording on the medium P; the medium transporting path 21 which transports the medium P; and the frame 104 which stands in the apparatus depth direction which is the direction that intersects the transporting direction of the medium with respect to the medium transporting path 21, and forms the opening 106 which can access the medium transporting path 21.

In other words, in the embodiment, via the opening 106, it is possible to access the medium transporting path 21 from the side (−X axis direction side). Accordingly, even when the jam is generated at the innermost position of the apparatus, it is possible to provide access from a location near to a jam generation position, and to easily perform the jam processing operation.

The transporting direction of the medium P in the embodiment is the apparatus width direction in the printer 10, and the frame 104 stands on the apparatus front surface side.

Therefore, as the opening 106 is positioned on the apparatus front surface side in the embodiment, according to this, it is possible to more easily perform the jam processing operation.

The printer 10 in the embodiment is provided with the unit body 94 which obtains the first state in which the medium transporting path 21 is formed and the second state in which the medium transporting path 21 is opened, in the frame 104, that is, the structure body 96. As the unit body 94 is in the second state, a part of the medium transporting path 21 is exposed to the inner side of the opening 106.

As a result, the medium transporting path 21 is more greatly exposed to the inner side of the opening 106, and accordingly, it is possible to more easily perform the jam processing operation.

The printer 10 in the embodiment is provided with the fourth transporting roller pair 42 which nips and transports the medium P to the inner side of the opening 106. In addition, as the unit body 94 is in the second state, one roller 42*a* which constitutes the fourth transporting roller pair 42 is separated from the other roller 42*b*. In addition, the fourth transporting roller pair 42 is a roller pair which is initially positioned at the downstream of the recording portion 18.

Then, as the unit body 94 is in a state of being extracted with respect to the apparatus main body 12, one roller 42*a* which constitutes the fourth transporting roller pair 42 is separated from the other roller 42*b*. For this reason, restriction of the medium P in the fourth transporting roller pair 42 is released, and accordingly, it is possible to more easily perform the jam processing operation.

Modification Example of Embodiment (1) The opening 106 in the embodiment is configured to be provided on the side of the position which corresponds to the fourth transporting roller pair 42, the fifth transporting roller pair 52, the sixth transporting roller pair 54, the eleventh transporting roller pair 66, the first flap 46, and the second flap 50 in the medium transporting path 21. However, instead of this configuration, the opening 106 may be provided at a position which corresponds to other configurations of the medium transporting path 21.

(2) In the embodiment, a configuration in which it is possible to access the inside of the opening 106 by moving the unit body 94 with respect to the apparatus main body 12 in a sliding manner is employed. However, instead of this configuration, a configuration in which it is possible to access the inside of the opening 106 without moving the unit body 94 with respect to the apparatus main body 12 in a sliding manner may be employed.

(3) In the embodiment, a configuration in which the opening 106 is provided in the frame 104 which is provided on the apparatus front side when the transporting direction of the medium P is the apparatus width direction is employed. However, instead of this configuration, a configuration in which the opening 106 is provided on the side surface of the apparatus when the transporting direction of the medium P is the apparatus depth direction may be employed. In other words, a configuration in which the opening 106 is provided to be able to be accessed from the direction which intersects the transporting direction of the medium in the medium transporting path 21 may be employed.

In addition, in the embodiment, the straight path 22, the switching-back path 24, the reversing path 26, and the face-down discharge path 28 according to the invention are employed in an ink jet printer which is an example of the recording apparatus. However, it is possible to generally employ other liquid ejecting apparatuses.

Here, the liquid ejecting apparatus is not limited to the recording apparatus, such as a printer, a copying machine, or a facsimile, which uses an ink jet type recording head, ejects the ink from the recording head, and performs recording on the recording medium. The liquid ejecting apparatus includes an apparatus which ejects the liquid corresponding to the purpose instead of the ink to the ejecting medium which corresponds to the recording medium from the liquid ejecting head which corresponds to the ink jet type recording head, and attach the liquid to the ejecting medium.

Other than the recording head, examples of the liquid ejecting head include a color material ejecting head which is used in manufacturing a color filter, such as a liquid crystal display, an electrode material (conductive paste) ejecting head which is used in forming an electrode, such as an organic EL display or a field emission display (FED), a living body organic matter ejecting head which is used in manufacturing a bio chip, a sample ejecting head as a precision pipette, or the like.

Furthermore, the invention is not limited to the above-described embodiment, and it goes without saying that various modifications are possible within a scope of the invention described in the range of the patent claims, and these modifications are included in the scope of the invention.

The entire disclosure of Japanese Patent Application No. 2014-065646, filed Mar. 27, 2014 is expressly incorporated by reference herein.

What is claimed is:

1. A recording apparatus, comprising:

a medium accommodation cassette which accommodates a medium;

a first transporting path which transports the medium which is fed from the medium accommodation cassette to the above and reverses the medium, and passes through a recording portion that performs recording on the medium in a straight line shape;

a second transporting path which is connected to a downstream of the first transporting path, and transports and switches back the medium in a reverse direction after transporting the medium which passes through the recording portion, to the above, and reversing the medium;

a third transporting path which is connected to the second transporting path and allows the medium transported in the reverse direction to bypass an upper side of the recording portion by going around and being disposed above the upper side of the recording portion, to be reversed, and to be converged at a position on an upstream side of the recording portion in the first transporting path;

a fourth transporting path which is connected to the downstream of the first transporting path, reverses the medium which passes through the recording portion and discharges the medium to be along an outer side of the second transporting path;

an outlet which is provided at a downstream end of the fourth transportation path, and discharges the medium; and a medium receiving tray which receives the medium discharged from the fourth transporting path, wherein the third transporting path is disposed along a side of the medium receiving tray that is opposite of a side that receives the medium, wherein, above the medium accommodation cassette, the first transporting path, the recording portion, the third transporting path, and the medium receiving tray are disposed to be overlapped with each other, wherein the second transporting path is curved on the inside of the fourth transport path, and wherein the second transport path performs a first transport operation which transports the medium in a first transport direction and performs a second transport operation which transports the medium in a second transport direction opposite the first transport direction after performing the first transport operation, the first transport operation and the second transport operation being performed in same transport path.

2. The recording apparatus according to claim 1, wherein the medium receiving tray obtains an upwardly inclined posture which is an upward posture toward a side far from an outlet of the fourth transporting path, and wherein the third transporting path is reversed after being inclined upwardly along the upwardly inclined posture of the medium receiving tray and converges with the first transporting path.

3. The recording apparatus according to claim 2, wherein, in the third transporting path, a roller pair for removing a skew is disposed in the middle of a reversing path.

4. The recording apparatus according to claim 2, further comprising:

a manual tray, wherein, at a converging portion between the third transporting path and the first transporting path, a feeding path of the manual tray is converged.

5. The recording apparatus according to claim 1, further comprising:

a first flap which switches a downstream of the first transporting path and an upstream of the second transporting path to be in a connected state and a disconnected state; and a second flap which connects the second transporting path and the third transporting path to each other when the connected state is switched to the disconnected state by the first flap.

6. The recording apparatus according to claim 5, wherein, after a first medium is fed to the first transporting path and recording is performed in the recording portion, the first transporting path and the second transporting path are connected to each other by the first flap, and the first medium is transported to the second transporting path, and wherein, after this, when a following second medium is fed to the first transporting path, the second transporting path and the third transporting path are connected to each other by the second flap, and the first medium is transported to the third transporting path, the second medium is transported to the recording portion, and recording is performed.

7. The recording apparatus according to claim 6, wherein, after the first medium is transported to the third transporting path, the first transporting path and the second transporting path are connected to each other by the first flap, and the second medium is transported to the second transporting path, and wherein, after this, the first medium which is reversed in the third transporting path is transported to the recording portion and recording is performed, the first flap is in the disconnected state, and the first transporting path and the fourth transporting path are connected to each other.

8. The recording apparatus according to claim 7, wherein the first medium is transported to the fourth transporting path, and wherein, when the second transporting path and the third transporting path are connected to each other by the second flap, and the second medium is transported to the third transporting path, a following third medium is fed to the first transporting path and is transported to the recording portion, and recording is performed.

9. The recording apparatus according to claim 1, wherein the second transporting path and the third transporting path are respectively provided with a plurality of spurs on a side which faces a recording surface of the medium on which recording is performed in the recording portion.

10. A recording apparatus, comprising:

a medium accommodation cassette which accommodates a medium;

a first transporting path which transports the medium which is fed from the medium accommodation cassette to the above and reverses the medium, and passes through a recording portion that performs recording on the medium in a straight line shape;

a second transporting path which is connected to a downstream of the first transporting path, and transports and switches back the medium in a reverse direction after transporting the medium which passes through the recording portion, to the above, and reversing the medium;

a third transporting path which is connected to the second transporting path and allows the medium transported in the reverse direction to bypass an upper side of the recording portion by going around and being disposed above the upper side of the recording portion, to be reversed, and to be converged at a position on an upstream side of the recording portion in the first transporting path;

a fourth transporting path which is connected to the downstream of the first transporting path, reverses the medium which passes through the recording portion and discharges the medium to be along an outer side of the second transporting path; and a medium receiving tray which receives the medium discharged from the fourth transporting path, wherein the third transporting path is disposed along a side of the medium receiving tray that is opposite of a side that receives the medium, wherein, above the medium accommodation cassette, the first transporting path, the recording portion, the third transporting path, and the medium receiving tray are disposed to be overlapped with each other, wherein the second transporting path is curved on the inside of the fourth transport path, and wherein the second transport path performs a first transport operation which transports the medium in a first transport direction and performs a second transport operation which transports the medium in a second transport direction opposite the first transport direction after performing the first transport operation, the first transport operation and the second transport operation being performed in the same transport path.

11. The recording apparatus according to claim 1, wherein the third transporting path is disposed along a bottom side of the medium receiving tray such that the bottom side configures a top portion of the third transporting path.

12. The recording apparatus according to claim 10, wherein the third transporting path is disposed along a bottom side of the medium receiving tray such that the bottom side configures a top portion of the third transporting path.

13. The recording apparatus according to claim 1, wherein the outlet is disposed adjacent to an opening which is provided at a downstream end of the second transporting path.

14. The recording apparatus according to claim 10, wherein an opening which is provided at a downstream end of the second transporting path is adjacent to an outlet which is provided at a downstream end of the fourth transportation path.

* * * * *